US008781360B2

(12) United States Patent
Takakuwa et al.

(10) Patent No.: US 8,781,360 B2
(45) Date of Patent: Jul. 15, 2014

(54) IMAGE FORMING APPARATUS HAVING A COVER AND A PRESSING MECHANISM FOR PRESSING A DEVELOPING CARTRIDGE WHEN CLOSING THE COVER

(71) Applicant: Brother Kogyo Kabushiki Kaisha, Nagoya (JP)

(72) Inventors: Yoshito Takakuwa, Aisai (JP); Yoshiya Tomatsu, Kasugai (JP); Atsushi Hayakawa, Okazaki (JP)

(73) Assignee: Brother Kyogo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/790,384

(22) Filed: Mar. 8, 2013

(65) Prior Publication Data

US 2013/0188988 A1 Jul. 25, 2013

Related U.S. Application Data

(63) Continuation of application No. 13/344,654, filed on Jan. 6, 2012, now Pat. No. 8,396,392, which is a continuation of application No. 11/525,940, filed on Sep. 25, 2006, now Pat. No. 8,099,018.

(30) Foreign Application Priority Data

Sep. 30, 2005 (JP) ..... 2005-288202

(51) Int. Cl.
*G03G 15/01* (2006.01)

(52) U.S. Cl.
USPC ..... 399/111

(58) Field of Classification Search
USPC ..... 399/111, 299
See application file for complete search history.

(56) References Cited

U.S. PATENT DOCUMENTS 6,134,403 A 10/2000 Haneda et al.
6,708,011 B2 3/2004 Nomura et al.
7,177,575 B2 2/2007 Okabe (Continued)

FOREIGN PATENT DOCUMENTS

JP 03-087858 A 4/1991
JP 5-088418 A 4/1993

(Continued)

OTHER PUBLICATIONS

JP Office Action dtd Jun. 15, 2010, JP Appln. 2005-288202, English translation.

(Continued)

*Primary Examiner* — Quana M Grainger
(74) *Attorney, Agent, or Firm* — Banner & Witcoff, Ltd.

(57) ABSTRACT

An image forming apparatus includes a main body; a process unit configured to be attached to and removed from the main body, the process unit being configured to integrally hold a plurality of image carriers arranged in a first direction; a plurality of developing cartridges provided in corresponding association with the image carriers, the developing cartridges configured to be attached to and removed from the process unit, each of the developing cartridges including a corresponding developer carrier, each of the developing cartridges being configured to supply developer to a corresponding image carrier; and a pressing mechanism provided in the main body, the pressing mechanism configured to press the developing cartridges, when attached to the process unit, in a direction that the developer carriers contact the image carriers.

12 Claims, 21 Drawing Sheets

(56) References Cited

U.S. PATENT DOCUMENTS

| | | | | |
|---|---|---|---|---|
| 7,206,523 | B2 * | 4/2007 | Watanabe et al. | 399/12 |
| 8,139,979 | B2 | 3/2012 | Koishi et al. | |
| 2002/0110386 | A1 | 8/2002 | Kanno et al. | |
| 2003/0053819 | A1 | 3/2003 | Nomura et al. | |
| 2004/0165910 | A1 * | 8/2004 | Sato et al. | 399/116 |
| 2005/0047823 | A1 | 3/2005 | Nakashima et al. | |
| 2005/0053394 | A1 | 3/2005 | Ishii et al. | |
| 2005/0069342 | A1 | 3/2005 | Kanno et al. | |
| 2005/0069347 | A1 | 3/2005 | Okabe | |
| 2006/0024080 | A1 | 2/2006 | Chadani et al. | |
| 2006/0127129 | A1 | 6/2006 | Jung et al. | |
| 2006/0216061 | A1 | 9/2006 | Yamaguchi | |
| 2006/0245784 | A1 | 11/2006 | Tsuzuki et al. | |
| 2006/0245785 | A1 | 11/2006 | Kawamura et al. | |
| 2006/0257164 | A1 | 11/2006 | Hoshi et al. | |
| 2007/0071495 | A1 | 3/2007 | Hashimoto et al. | |
| 2007/0160386 | A1 | 7/2007 | Kawamura | |
| 2008/0080892 | A1 | 4/2008 | Yamaguchi | |
| 2008/0159772 | A1 | 7/2008 | Koishi et al. | |
| 2008/0159775 | A1 | 7/2008 | Koishi et al. | |
| 2008/0260420 | A1 | 10/2008 | Maehata et al. | |
| 2009/0123181 | A1 * | 5/2009 | Ito et al. | 399/167 |

FOREIGN PATENT DOCUMENTS

| | | | |
|---|---|---|---|
| JP | 07-199651 | A | 8/1995 |
| JP | 08-169586 | A | 7/1996 |
| JP | 10-171327 | A | 6/1998 |
| JP | 2002-174938 | A | 6/2002 |
| JP | 2002-351283 | A | 12/2002 |
| JP | 2003-015378 | A | 1/2003 |
| JP | 2003-043764 | A | 2/2003 |
| JP | 2003-167499 | A | 6/2003 |
| JP | 2004-013030 | A | 1/2004 |
| JP | 2004-264791 | A | 9/2004 |
| JP | 2005-107189 | A | 4/2005 |

OTHER PUBLICATIONS

JP Office Action dtd Aug. 31, 2010, JP Appln. 2005-288202, English translation.

* cited by examiner

IMAGE FORMING APPARATUS HAVING A COVER AND A PRESSING MECHANISM FOR PRESSING A DEVELOPING CARTRIDGE WHEN CLOSING THE COVER

CROSS REFERENCE TO RELATED APPLICATION

This application is a continuation of U.S. application Ser. No. 13/344,654, filed Jan. 6, 2012, which is a continuation of U.S. application Ser. No. 11/525,940, filed Sep. 25, 2006, now U.S. Pat. No. 8,099,018 B2, issued Jan. 17, 2012, which claims priority from Japanese Patent Application No. 2005-288202, filed on Sep. 30, 2005, the entire subject matter of which are incorporated herein by reference.

FIELD

The invention relates to an image forming apparatus, such as a laser printer and a process unit and a developing cartridge for use in the image forming apparatus.

BACKGROUND

A known tandem image forming apparatus is provided with photosensitive members, which are horizontally arranged in tandem with each other, in association with yellow, magenta, cyan and black toner. Such a tandem image forming apparatus can print in color at substantially the same speed as printing in monochrome, because a toner image of each color is formed substantially at the same time on the corresponding one of the photosensitive members and each of the different colored images is sequentially laid on top of each other on a sheet while the sheet passes through the photosensitive members.

U.S. Pat. No. 6,708,011 proposes a tandem-type color image forming apparatus including a photosensitive member cartridge in which photosensitive members for each color are supported by a frame. In this image forming apparatus, the photosensitive member cartridge is slidingly attached to and removed from an apparatus body and developing cartridges for developing an electrical latent image formed on each photosensitive member are attached to and removed from the frame.

In the proposed image forming apparatus, guide ridges are formed on two opposing side surfaces of each developing cartridge. At the inner upper sides of two opposing side plates of the frame, there are provided guide grooves for receiving the guide ridges at constant positions corresponding to the photosensitive members. The guide ridges are inserted from above in the associated guide grooves, so that the developing cartridges are mounted in the frame. The developing cartridges are withdrawn from the frame along the guide grooves. The frame is provided with fixing levers in association with the guide grooves. The developing cartridges are fixed with respect to the associated photosensitive members by the fixing levers.

SUMMARY

According to illustrative aspects of the invention, a developing cartridge is provided that prevents a projection from being broken when a developer carrier is driven and a process unit and an image forming apparatus including the developing cartridge are provided.

BRIEF DESCRIPTION OF THE DRAWINGS

Illustrative aspects of the invention will be described in detail with reference to the following figures in which like elements are labeled with like numbers and in which.

DETAILED DESCRIPTION

Illustrative aspects of the invention will be described in detail below with reference to the accompanying drawings.

First, general structures of a color laser printer 1 will be described below.

Figure 1:
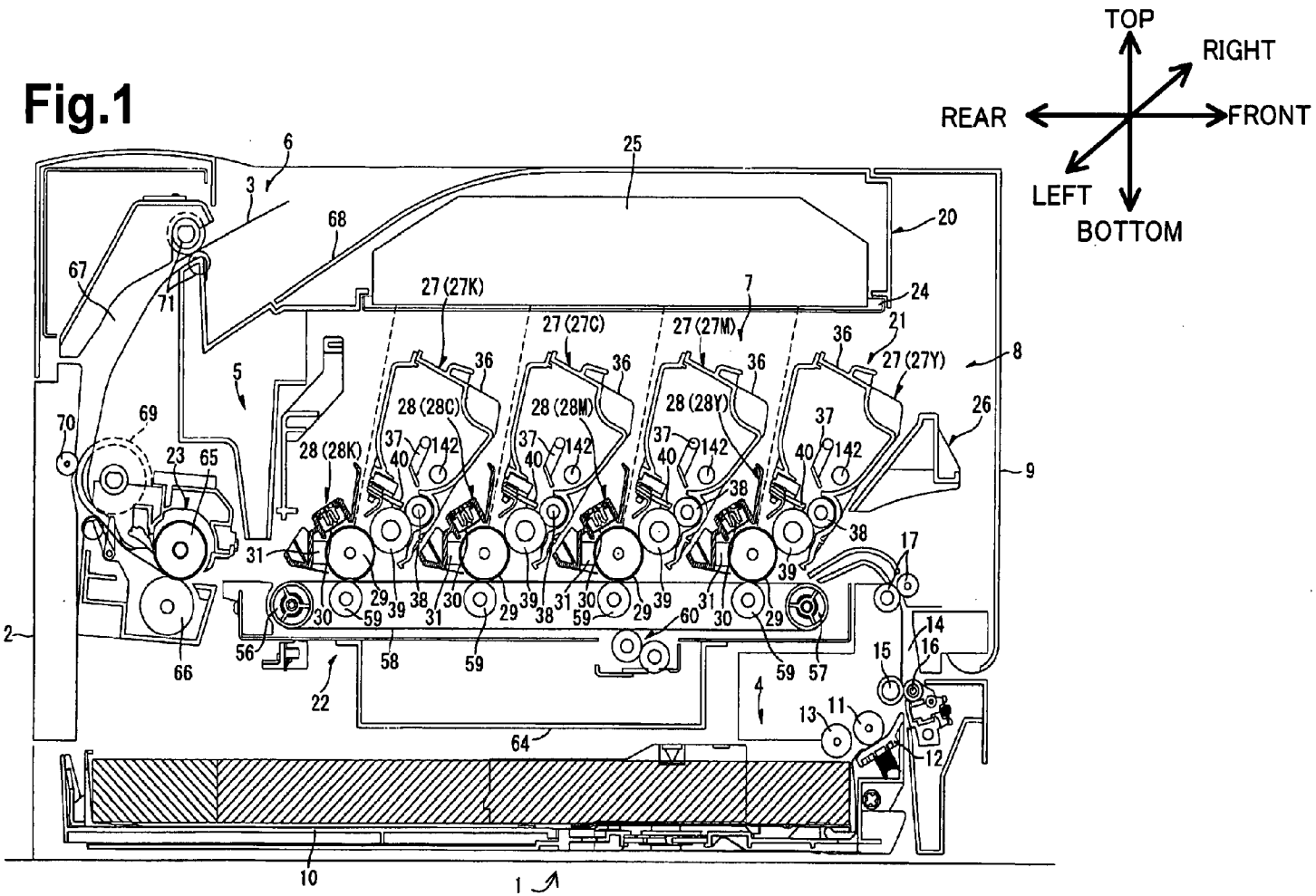
FIG. 1 is a sectional side view showing a general structure of a color laser printer as an image forming apparatus according to an aspect of the invention.

In FIG. 1, the color laser printer 1 is a tandem color laser printer in which a plurality of drum sub units 28 is arranged in tandem with each other in a horizontal direction. The color laser printer 1 includes, in a body casing 2, a sheet supply section 4 that supplies a sheet 3, an image forming section 5 that performs image formation on the sheet 3 fed therein, and a sheet ejection section 6 that ejects the sheet 3 on which the image is formed.

In the following description, the right side in FIG. 1 is referred to as the front side of the printer 1, and an opposite side (the left side in FIG. 1) is referred to as the rear side of the printer 1, as shown in arrows in FIG. 1. The right and left sides of the printer 1 are defined when the printer 1 is viewed from the front side. More specifically, the left and right sides of the printer 1 are front and rear sides, respectively, with respect to a direction perpendicular to the sheet of FIG. 1. Unless otherwise specified, the front, rear, left, right, top and bottom of the drum unit 26 and a developing cartridge 27 are defined in conjunction with an orientation in which the drum unit 26 and the developing cartridge 27 are installed in the body casing 2.

The body casing 2 has a substantially rectangular box shape in side view. The body casing 2 has a drum accommodating space 7 for accommodating a drum unit 26, which will be described in detail below.

An opening 8 that communicates with the drum accommodating space 7 is provided at one end in the body casing 2. A front cover 9 to cover or uncover the opening 8 is disposed at the front side (right side in FIG. 1) of printer 1. The front cover 9 is supported so as to open and close by a pair of cover support members 398 (FIG. 16), so that the front cover 9 is movable between an open position where the front cover 9 is inclined frontward of the body casing 2 to uncover the opening 8, and a closed position where the front cover 9 is in an upright position along the front face of the body casing 2 to cover the opening 8. With the opening 8 in the open position, the drum unit 26 can be inserted in or removed from the drum accommodating space 7 through the opening 8.

The sheet supply section 4 is provided at a bottom portion of the body casing 2. The sheet supply section 4 includes a sheet supply tray 10, a separation roller 11, a separation pad 12, a pickup roller 13, and a sheet supply path 14. The sheet supply tray 10 holds sheets 3 therein. The separation roller 11 and the separation pad 12 are disposed at the upper front end of the sheet supply tray 10 to face each other. The pickup roller 13 is disposed behind the separation roller 11. The sheets 3 are fed along the sheet supply path 14.

The sheet supply path 14 is formed in a substantially U shape viewed from a side. An upstream end of the sheet supply path 14 with respect to a sheet feeding direction is disposed near the separation roller 11. A downstream end of the sheet supply path 14 is disposed near a front side of a conveyor belt 58 (described below). A sheet dust removing roller 15 and a pinch roller 16 facing each other are disposed in front of the separation roller 11 above the roller 11 in the sheet supply path 14. A pair of register rollers 17 is disposed above the sheet dust removing roller 15 and the pinch roller 16.

The image forming section 5 includes a scanner unit 20, a process unit 21, a transfer unit 22, and a fixing unit 23.

The scanner unit 20 is disposed in an upper portion of the body casing 2. The scanner unit 20 includes a support plate 24 extending in the front-rear and right-left directions, and an exposure unit 25 fixed on the upper surface of the support plate 24.

The process unit 21 is disposed below the scanner unit 20 and above the sheet supply section 4. The process unit 21 includes a drum unit 26, as a tandem process unit, and four developing cartridges 27 for each color.

The drum unit 26 includes four drum sub units 28, as image carrier holder units, for each color. That is, the drum sub units 28 include a yellow drum sub unit 28Y, a magenta drum sub unit 28M, a cyan drum sub unit 28C and a black drum sub unit 28K.

The drum sub units 28 are arranged in a row with some distance between adjacent drum sub units 28 in the front-rear direction. More specifically, the yellow drum sub unit 28Y, the magenta drum sub unit 28M, the cyan drum sub unit 28C, and the black drum sub unit 28K are arranged in this order from the front to the rear.

Figure 2:
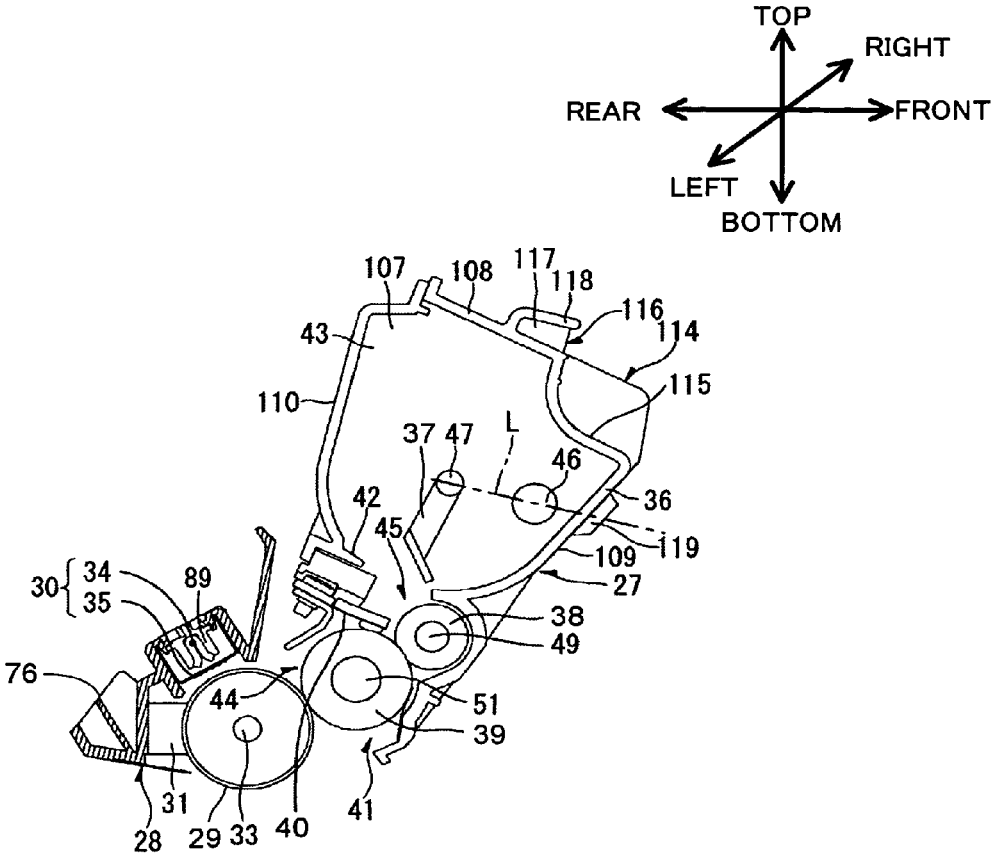
FIG. 2 is a sectional side view showing a developing cartridge and a drum sub unit shown in FIG. 1.

As shown in FIG. 2, each drum sub unit 28 holds a photosensitive drum 29, as an image carrier, a scorotron charger 30, and a cleaning brush 31.

The photosensitive drum 29 extends along the right-left direction. The cylindrical photosensitive drum 29 is rotatably supported in the drum sub unit 28. The surface of the photosensitive drum 29 is uniformly charged by the charger 30 while the amount of charge applied to the photosensitive drum 29 is controlled. The cleaning brush 31 is disposed to remove paper dust or fibers on the photosensitive drum 29.

The four developing cartridges 27 are configured to be detachably mounted in the corresponding drum sub units 28 provided for each color, as shown in FIG. 1. That is, the developing cartridges 27 includes a yellow developing cartridge 27Y detachably mountable in the yellow drum sub unit 28Y, a magenta developing cartridge 27M detachably mountable in the magenta drum sub unit 28M, a cyan developing cartridge 27C detachably mountable in the cyan drum sub unit 28C, and a black developing cartridge 27K detachably mountable in the black drum sub unit 28K.

As shown in FIG. 2, each developing cartridge 27 includes a developing frame 36, and an agitator 37, a supply roller 38, a developing roller 39, as a developer carrier, and a layer thickness regulating blade 40 that are disposed in the developing frame 36.

The yellow developing cartridge 27Y contains yellow toner, the magenta developing cartridge 27M contains magenta toner, the cyan developing cartridge 27C contains cyan toner, and the black developing cartridge 27K contains black toner. Each developing cartridge 27 contain, for example, positively chargeable non-magnetic single component polymerized toner.

The transfer unit 22 is disposed above the sheet supply section 4 and below the process unit 21 in the body casing 2, along the front-rear direction, as shown in FIG. 1. The transfer unit 22 includes a drive roller 56, a driven roller 57, a conveyor belt 58, transfer rollers 59, and a cleaning unit 60.

The sheet 3 supplied from the sheet supply section 4 is fed from the front to the rear by the conveyor belt 58 circulated by the drive roller 56 and the driven roller 57, so as to sequentially pass transfer positions between the conveyor belt 58 and the photosensitive drums 29 of the drum sub units 28. While the sheet 3 is being fed, each of the different colored toner images carried on the photosensitive drums 29 of the drum sub units 28 are sequentially transferred on top of each other on the sheet 3. Thus, a multi-color image is formed on the sheet 3.

More specifically, when a yellow toner image carried on the photosensitive drum 29 of the yellow drum sub unit 28Y is transferred to the sheet 3, a magenta toner image formed on the photosensitive drum 29 of the magenta drum sub unit 28M is then transferred onto the sheet 3 having the yellow toner image transferred thereon. Similarly, a cyan toner image formed on the photosensitive drum 29 of the cyan drum sub unit 28C and a black toner image formed on the photosensitive drum 29 of the black drum sub unit 28K are transferred and laid on top of each other on the sheet 3. Thus, a multicolor image is formed on the sheet 3.

The fixing unit 23 is disposed behind the black drum sub unit 28K in the body casing 2 to face, in the front-rear direction, the transfer position between photosensitive drum 29 and the conveyor belt 58. The fixing unit 23 includes a heat roller 65 and a pressure roller 66.

The sheet 3 is fed to the fixing unit 23 where the color toner image transferred on the sheet 3 is thermally fixed while the sheet 3 passes between the heat roller 65 and the pressure roller 66.

In the sheet ejection section 6, the sheet 3 is fed from the fixing unit 23 along a sheet ejection path 67 to a feed roller 69 and a pinch roller 70, and ejected by ejection rollers 71 onto a sheet ejection tray 68.

A pressing mechanism 120 will be described in detail below.

Figure 4:
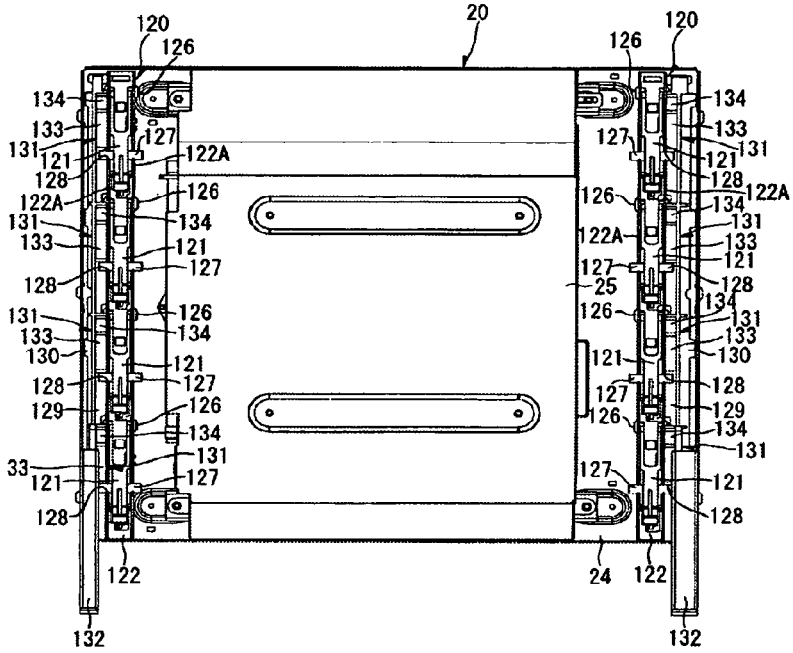
FIG. 4 is a plan view of a scanner section shown in FIG. 1.
Figure 5:
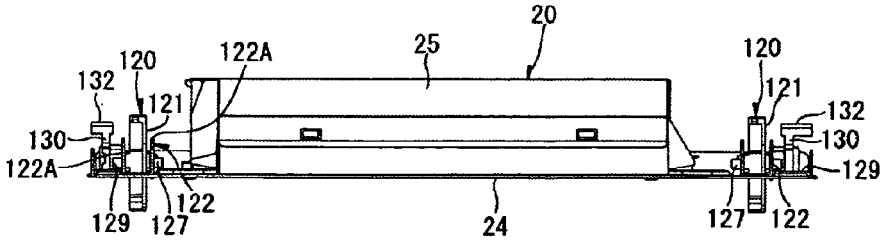
FIG. 5 is a front view of the scanner section shown in FIG. 4.

The color laser printer 1 includes a pair of pressing mechanisms 120, as shown in FIGS. 4 and 5, configured to press the developing cartridges 27 in a direction that the developing rollers 39 contact the corresponding photosensitive drums 29 when the developing cartridges 27 are set in the corresponding drum sub units 28 of the drum unit 26.

A pair of pressing mechanisms 120 is disposed opposite to each other across the exposure unit 25 of the scanner unit 20 with respect to the width direction of the scanner unit 20 (right and left direction in FIGS. 4 and 5). The pressing mechanisms 120 are supported by the support plate 24 of the scanner unit 20. In other words, the pressing mechanism 120 is disposed at each end of the support plate 24 of the scanner unit 20 with respect to its width direction, so as to interpose the exposure unit 25 between the pressing mechanisms 120.

Figure 6:
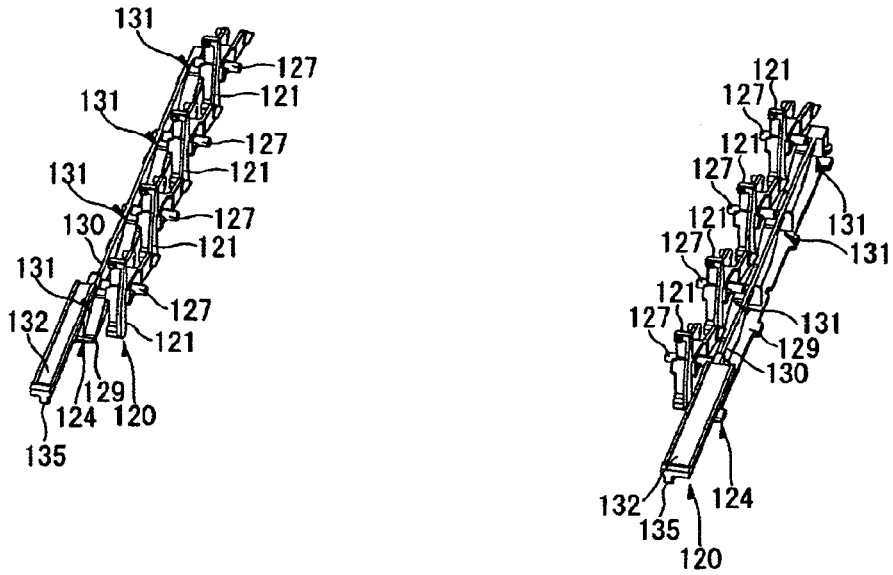
FIG. 6 is a perspective view of pressing mechanisms shown in FIG. 4 viewed from an upper front right side.
Figure 7:
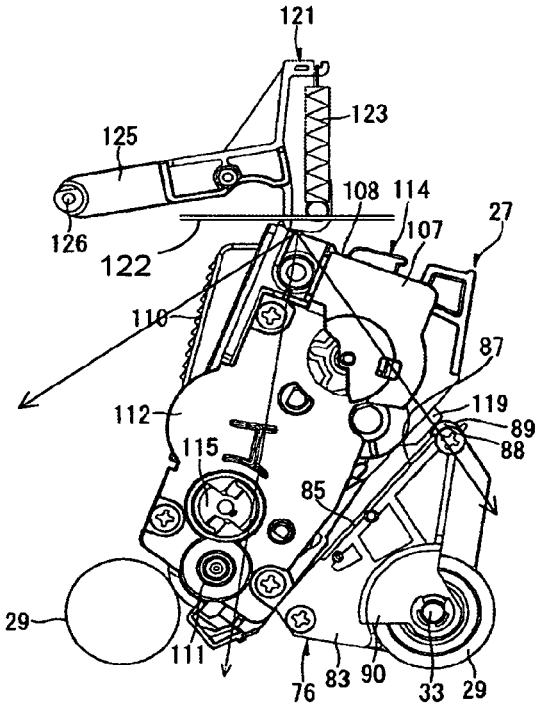
FIG. 7 is a side view of the developing cartridge pressed by the pressing mechanism shown in FIG. 6.

As shown in FIGS. 4-8, the pressing mechanisms 120 are provided with pressing members 121, holding members 122, coil springs 123, and first linear cams 124. The pressing members 121 are provided in association with the developing cartridges 27. The pressing members 121 are movable between a pressing position to press the developing cartridges 27 and a separation position to separate from the developing cartridges 27. The holding members 122 are fixed on the upper surface of the support plate 24 of the scanner unit 20 and are formed into a substantially upwardly-open "U" shape in cross section. The coil springs 123 urge the corresponding pressing members 121 toward the pressing position, as shown in FIG. 7. The first linear cams 124 are configured to move the pressing mechanisms 120 in synchronization with each other.

Figure 8:
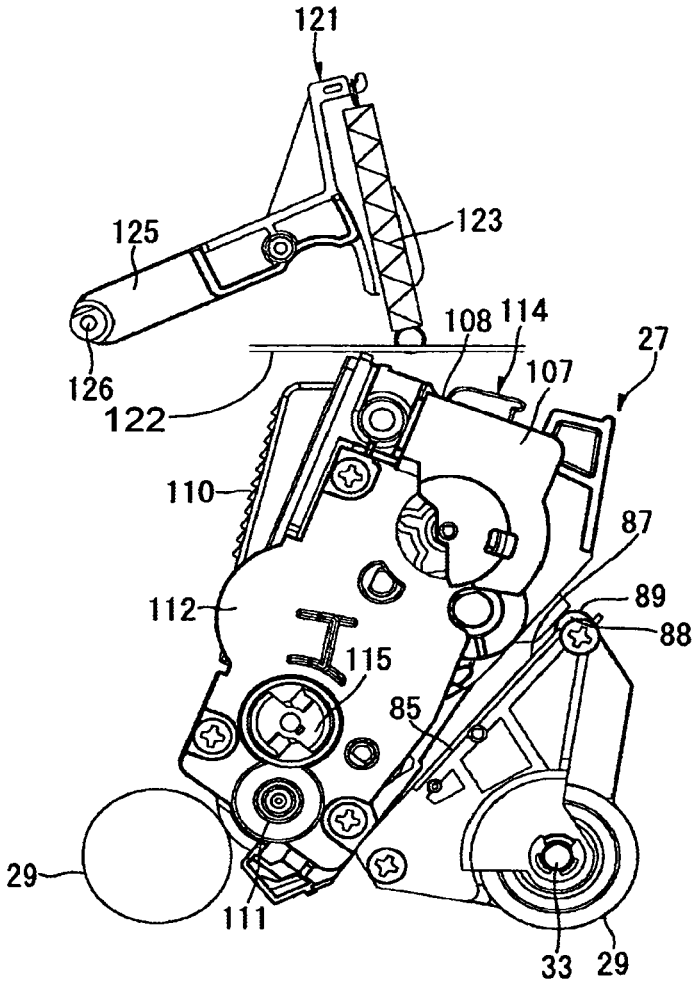
FIG. 8 is a side view of the developing cartridge separated from the pressing mechanism shown in FIG. 6.

Each pressing member 121 is formed in a substantially rectangular shape in side view, as shown in FIGS. 7 and 8. The pressing member 121 is integrally formed with a support arm 125 extending rearward from a central portion of the pressing member 121 with respect to its longitudinal direction. The pressing member 121 is disposed between side plates 122A of the holding member 122 as shown in FIG. 5, and a rear end of the support arm 125 is pivotally supported about a support shaft 126 disposed between the side plates 122A. The pressing member 121 is integrally formed with a guide shaft 127 extend from a central portion of each side of the pressing member 121 with respect to its longitudinal direction along its thickness direction (width direction of the scanner 20/right and left directions in FIGS. 4-6).

Figure 16:
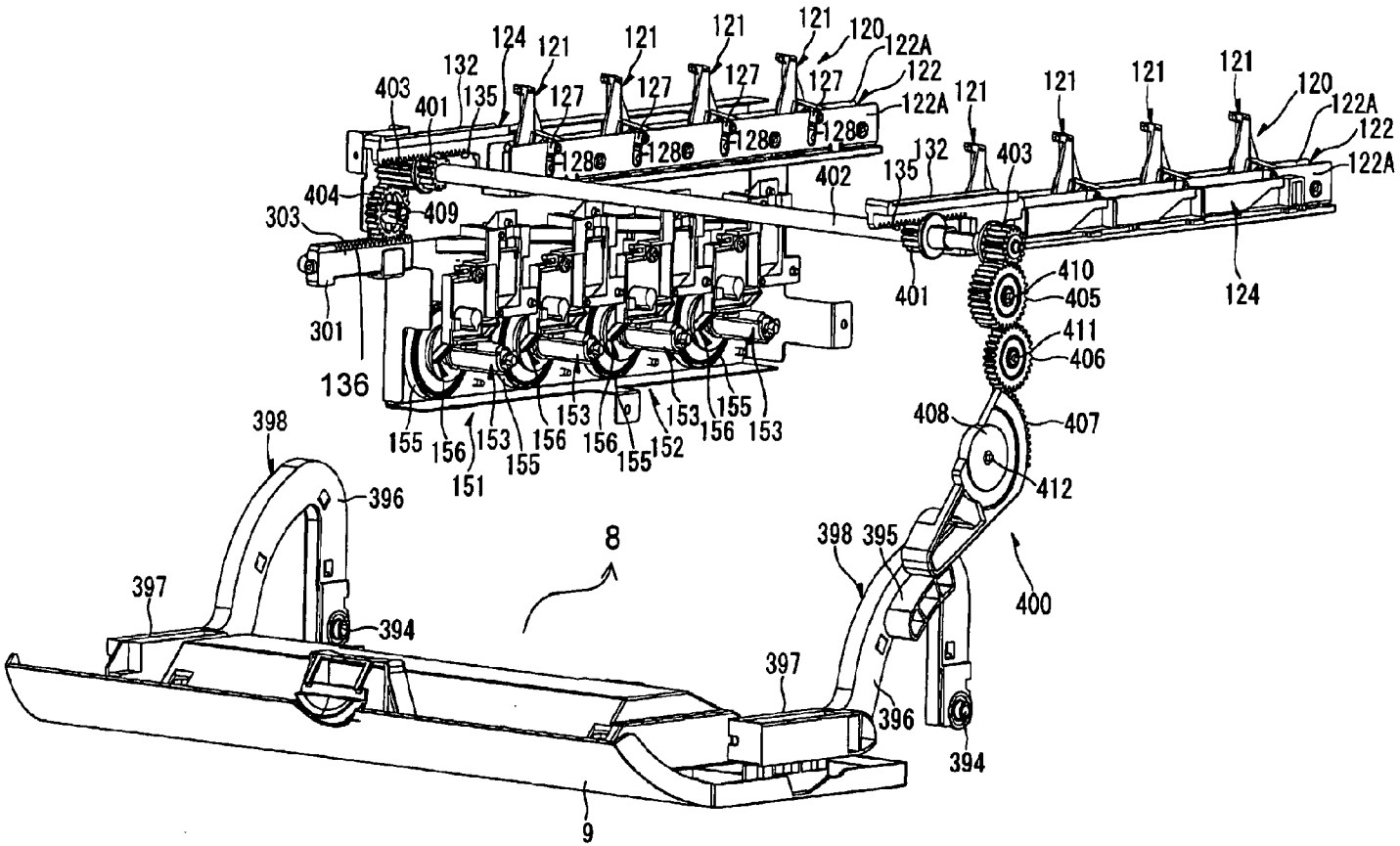
FIG. 16 is a perspective view of the pressing mechanisms, the drive force transmission unit, and an interlocking mechanism provided in the laser printer shown in FIG. 1 viewed from a front right side when the front cover is open.

The side plates 122A in FIG. 4 of the holding member 122 are formed with substantially U-shaped grooves 128, as will be best seen in FIG. 16, extending downward from upper edges of the side plates 122A. Each side plate 122A has four grooves 128 spaced away from each other in the front-rear direction. Each end of the guide shaft 127 of the pressing member 121 fit in the relevant grooves 128.

An end of the coil spring 123 is hooked to an upper end of the pressing member 121, as shown in FIGS. 7 and 8, and the other end of the coil spring 123 is fixed in the holding member 122.

The first linear cams 124 are disposed outside the holding members 122 with respect to the width direction of the scanner unit 20 (right and left direction in FIG. 4-6), so as to linearly move in the front-rear direction. As shown in FIGS. 4 and 6, each first linear cam 124 is integrally provided with a base plate 129 extending in the front-rear direction along the upper surface of the support plate 24 of the scanner unit 20, a vertical plate 130 extending upward from the base plate 129 along the front-rear direction, a cam portion 131 having a substantially triangular shape that protrudes upwardly from the base plate 129 at a position inside the vertical plate 130 with respect to the width direction of the scanner unit 20, and a gear portion 132 that is fixed on an upper end of the vertical plate 130 and extends frontward from the vertical plate 130.

Four cam portions 131 are provided in association with the guide shafts 127 of the pressing members 121, and are equidistanced in the front-rear direction. As shown in FIG. 4, each cam portion 131 includes an inclined surface 133 that is inclined from the lower front side to the upper rear side, and a flat surface 134 extending from a rear end of the inclined surface 133 parallel with the base plate 129.

The gear portion 132 is formed in a substantially rectangular shape in plan view. A rack gear 135 in FIG. 6 that engages with a pressing member drive gear 401 (described below) is formed on the underside of the gear portion 132, as shown in FIG. 16.

Figure 3:
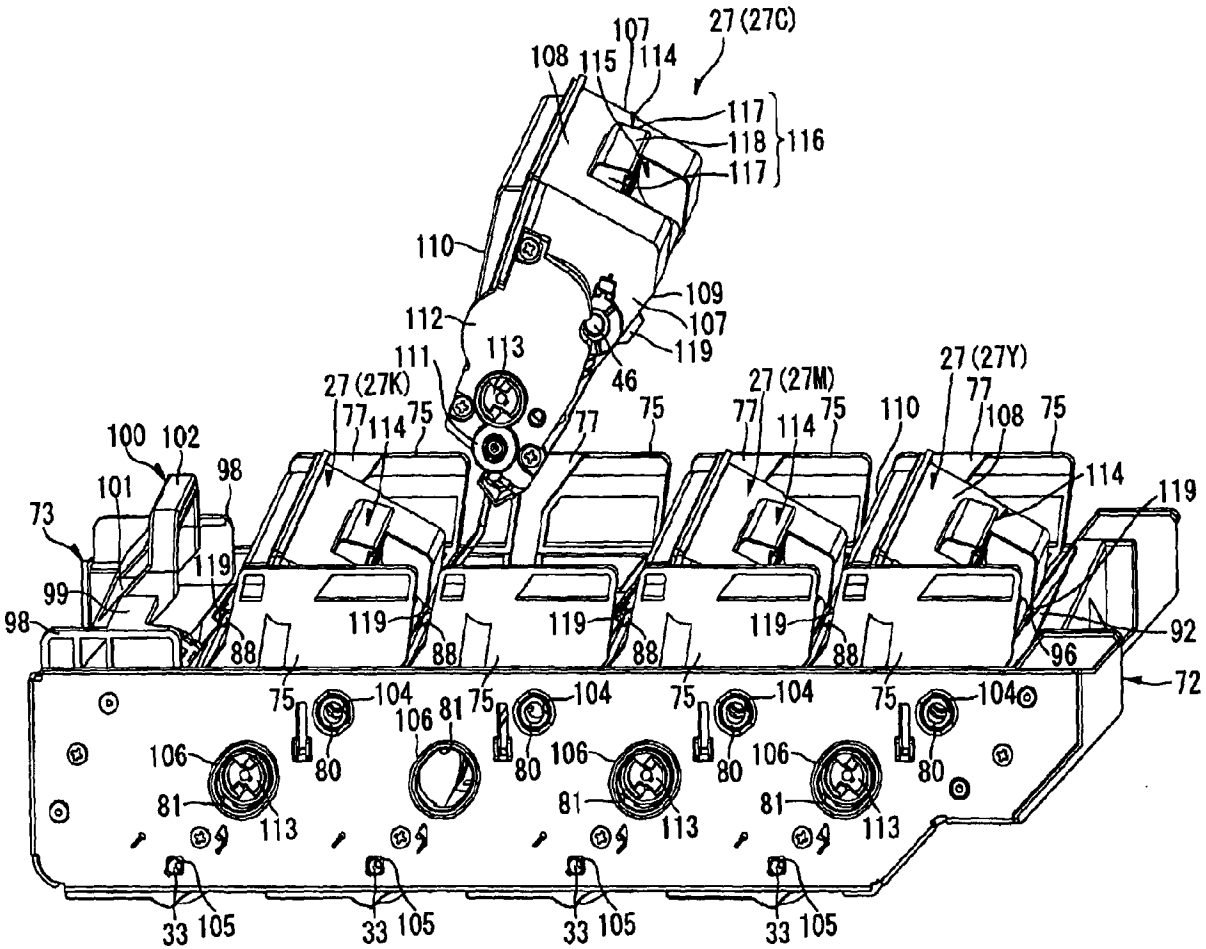
FIG. 3 is a perspective view of the drum unit.

With the first linear cams 124 disposed at the rearmost position, the base plates 129 face the guide shafts 127 of the pressing members 121. As shown in FIG. 7, by an urging force of the coil springs 123, lower ends of the pressing members 121 protrude downward below the support plate 24 via openings (not shown) formed in the holding members 122 and the support plate 24 of the scanner unit 20, and contacts upper ends of the top walls 108 of the developing frames 36 of the developing cartridges 27. Thus, the pressing members 121 press the developing cartridges 27 downward, so that the developing rollers 39 of the developing cartridges 27 can be pressed against the corresponding photosensitive drum 29. At this time, force is applied by each pressing member 121 to the developing cartridges 27 in the downward direction. The downward pressing force applied by the pressing members 121 includes a component that presses the protrusions 119 of the developing cartridges 27 against support portions 88, 96 (FIG. 3). Thus, the developing cartridges 27 can be pressed firmly against the relevant drum sub units 28 and placed in position in the drum sub units 28.

When the first linear cams 124 are moved frontward from the rearmost position, the guide shaft 127 of each pressing member 121 relatively moves along the inclined surface 133 toward the flat surface 134, so that each guide shaft 127 is raised and the support arm 125 is pivotally moved upward, as shown in FIG. 8. Thus, each pressing member 121 moves from the pressing position to the separation position. With such a structure, pressing of the developing cartridges 27 by the pressing members 121 discontinues.

A drive force transmission unit 151 will be described in detail below.

The color laser printer 1 is provided in the body casing 2 with a pair of side plates 399 (only the left side plate 399 shown in FIG. 19) opposing each other in the width direction of the laser printer 1 across the process unit 21 (FIG. 1). The drive force transmission unit 151, as shown in FIG. 9, is disposed on an outer surface of the left side plate 399 to transmit drive force to each developing cartridge 27.

Figure 9:
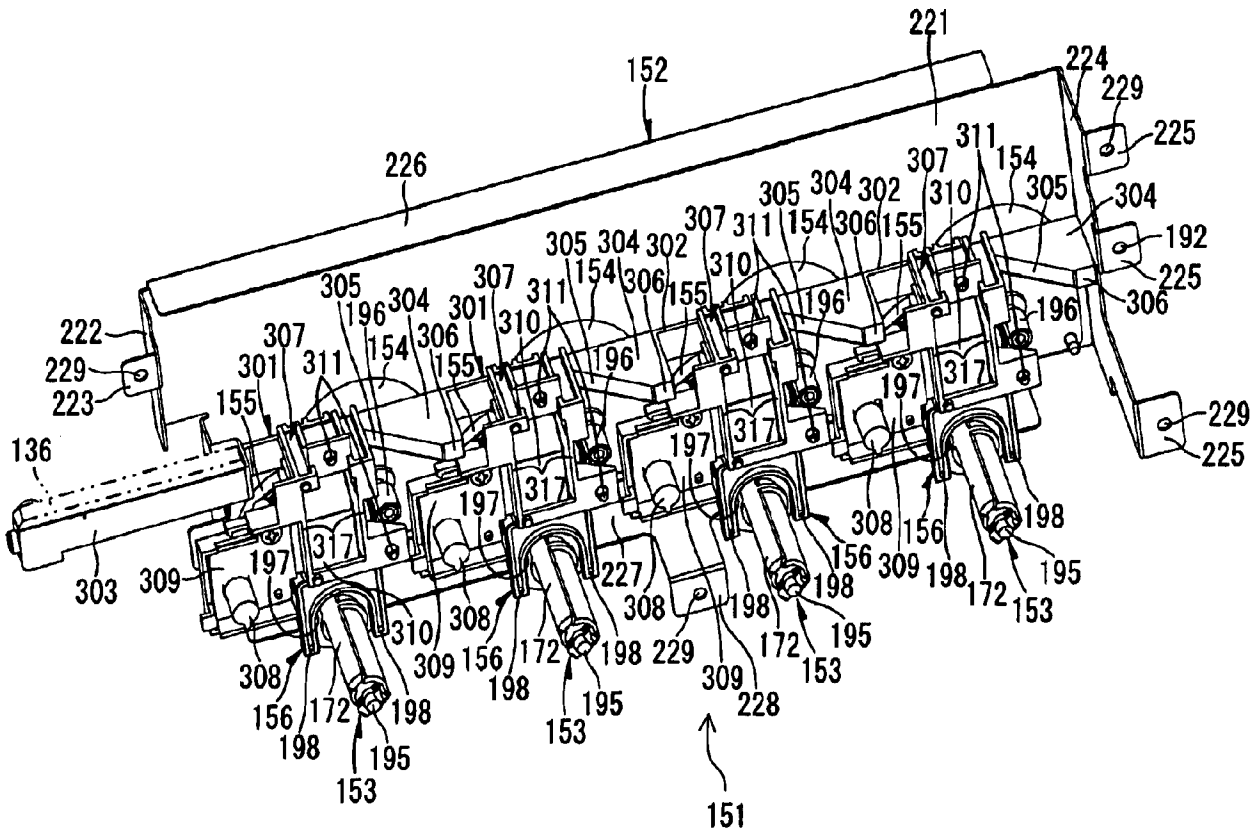
FIG. 9 is a perspective view of a drive force transmission unit provided in the color laser printer shown in FIG. 1 viewed from an upper right side.

As shown in FIG. 9, the drive force transmission unit 151 includes a holder 152 configured to be attached to the outer surface of the left side plate 399, and four drive gears 155, four coupling male members 153, four springs 191, four motors 154, and four regulating members 156 that are held by the holder 152.

The holder 152 is made of a metal plate, and integrally provided with a main plate 221, a front plate 222, a front fixing portion 223, a rear plate 224, a rear fixing portion 225, an upper plate 226, a lower plate 227, and a lower fixing portion 228. The main plate 221 is formed in a substantially rectangular shape, which extends in the front-rear direction, in side view. The front plate 222 extends rightward toward the side plate 399 from a front edge of the main plate 221. The front fixing portion 223 extends frontward from the right end of the front plate 222. The rear plate 224 is formed in a substantially L-shape in front view and extends rightward toward the side plate 39 from the rear edge of the main plate 221. The rear fixing portion 225 is disposed on the right end of the rear plate 224 at three positions spaced away from each other in the vertical direction. Each rear fixing portion 225 extends rearward. The upper plate 226 extends rightward toward the side plate 399 from the upper end of the main plate 221. The lower plate 227 extends rightward toward the side plate 399 from the lower end of the main plate 221. The lower fixing portion 228 is formed into a substantially L-shape in cross section. The lower fixing portion 228 extends rightward from a substantially central portion of the lower plate 227 with respect to the front-rear direction and bends downward.

The holder 152 is attached to the side plate 399 by first making the fixing portions 223, 225, 228 contact with the outer surface of the side plate 399, inserting screws into screw holes 229 of the fixing portions 223, 225, 228, and then screwing the holder 152 on the side plate 399.

Figure 15A:
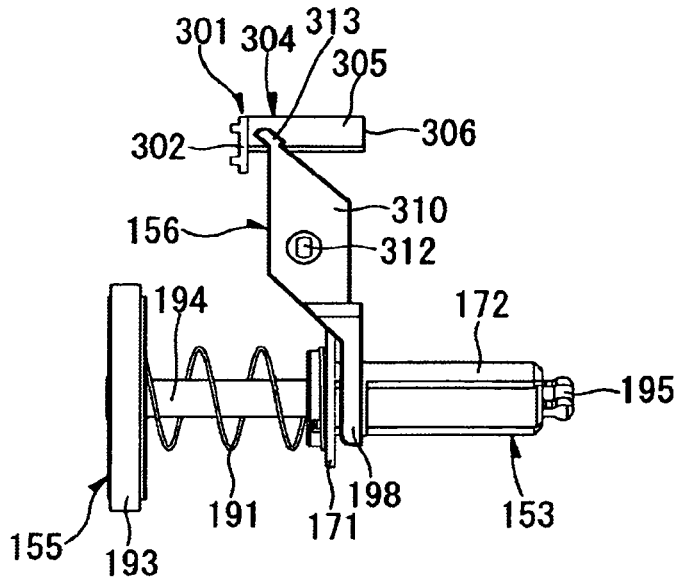
FIGS. 15A and 15B are front views of the coupling male member shown in FIG. 9.
Figure 15B:
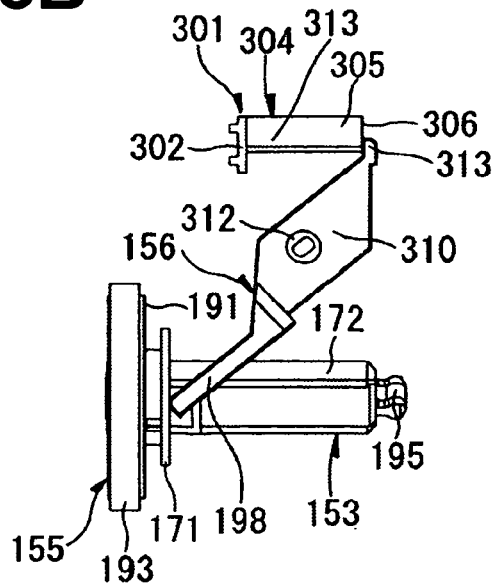

Each drive gear 155 is rotatably disposed on a surface of the main plate 221 of the holder 152 that faces the left side plate 399, at a position opposite a coupling female member 113 of each developing cartridge 27 when the drum unit 26 mounting the developing cartridges 27 thereon is installed in the body casing 2. As shown in FIGS. 15A and 15B, each drive gear 155 includes a gear body 193 of a substantially disc shape and a connection boss 194 of a substantially cylindrical shape. The gear body 193 has a plurality of teeth formed on its rim. The connection boss 194 is connected to the center of the gear body 193 so as to extend in the width direction of the printer 1.

The coupling male members 153 are arranged in the front-rear direction as shown in FIG. 9. As shown in FIGS. 15A and 15B, each coupling male member 153 integrally includes a main body 172, a flange 171, and a connection portion 195. The connection boss 194 of the drive gear 155 is slidably inserted into the main body 172 along the width direction of the printer 1 (along an axial direction of the drive gear 155), so as not to rotate relative to the main body 172. The flange 171 is disposed on a side of the main body 172 nearer to the drive gear 155, so as to extend radially. The connection portion 195 is disposed at an end of the main body 172 opposite to the flange 171. The connection portion 195 is connected to the coupling female member 113, so as not to rotate relative to the coupling female member 113. Each coupling male member 153 is disposed so as to advance to a coupling position, as shown in FIG. 15A where the coupling male member 153 is coupled to the coupling female member 113 of the developing cartridge 27 and retract to a uncoupling position, as shown in FIG. 15B, where the coupling male member 153 is uncoupled or released from the coupling female member 113 of the developing cartridge 27.

Each spring 191 may be a compression spring, and is wound around the connection boss 194 of each drive gear 155. An end of the spring 191 is connected to the gear body 193 of the drive gear 155 and the other end is connected to the main body 172 of the coupling male member 153. The spring 191 urges the coupling male member 153 toward the coupling position.

Figure 12:
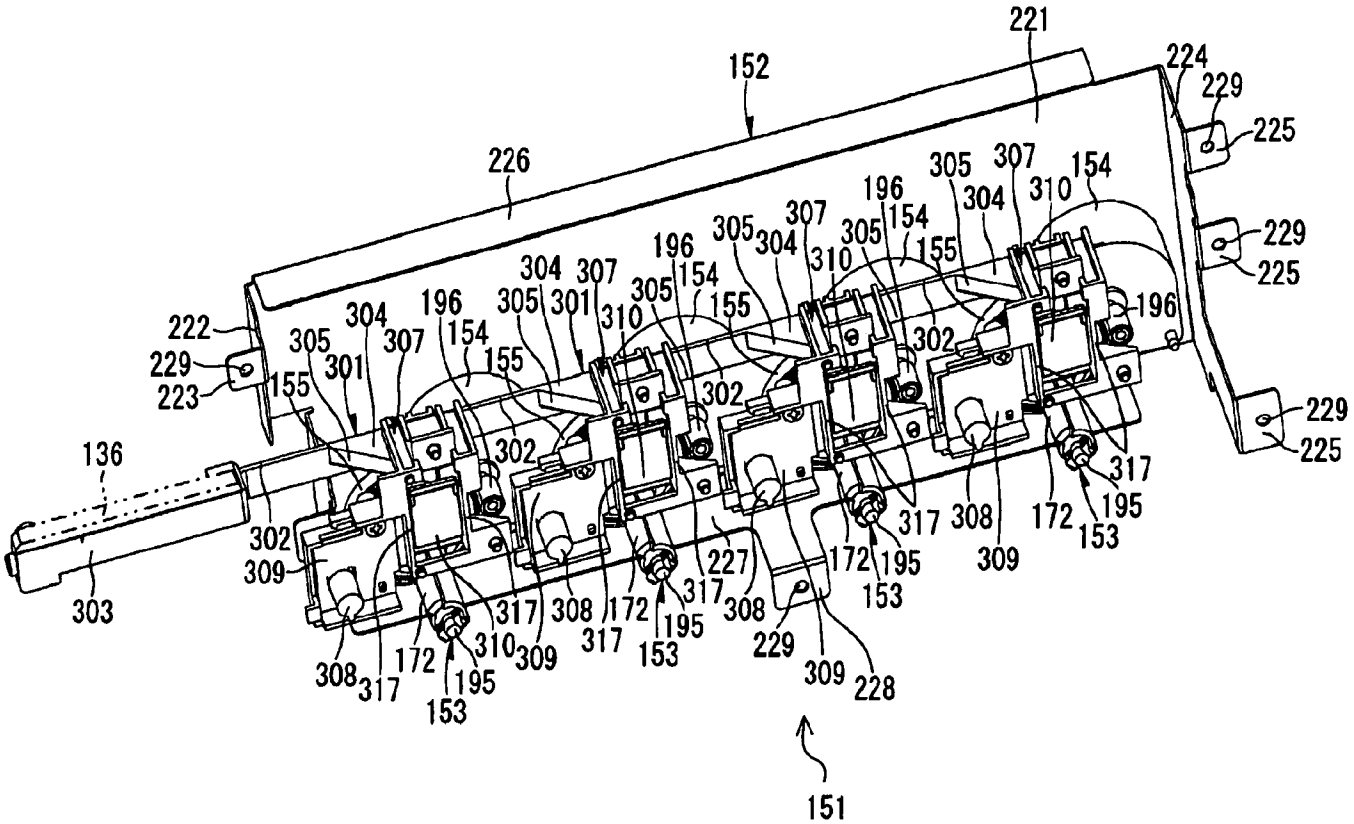
FIG. 12 is a perspective view of the drive force transmission unit shown in FIG. 9 viewed from an upper right side, wherein coupling male members of the drive force transmission unit are retracted.
Figure 13:
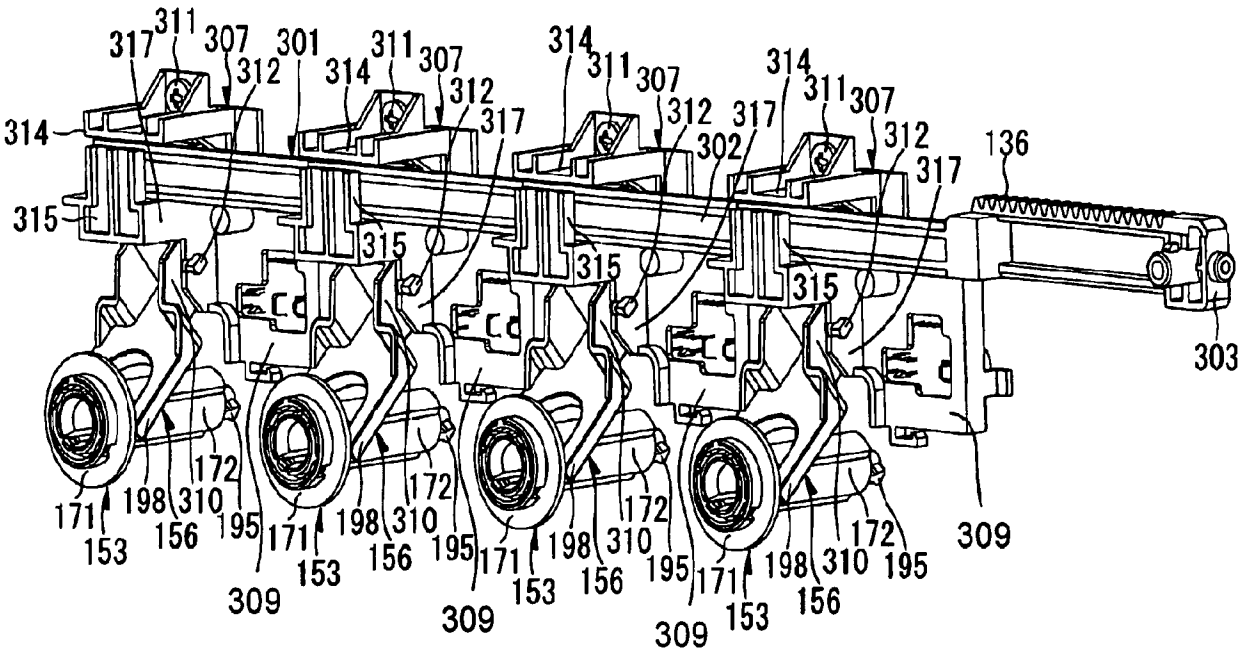
FIG. 13 is a perspective view of the drive force transmission unit shown in FIG. 12 viewed from a front left side, wherein the holder, the motors, and the developing drive gears are not illustrated in FIG. 13.
Figure 14:
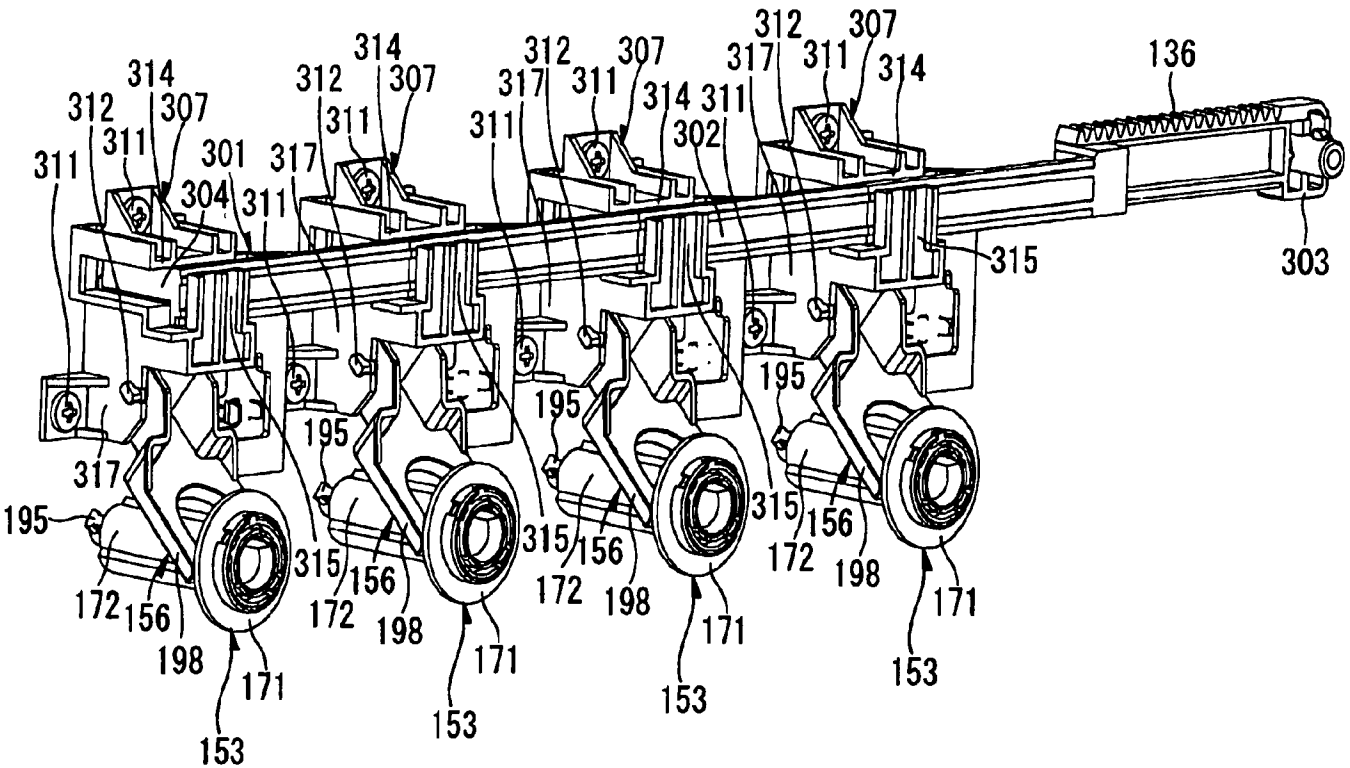
FIG. 14 is a perspective view of the drive force transmission unit shown in FIG. 12 viewed from a rear left side, wherein the holder, the motors, and the developing drive gears are illustrated in FIG. 14.

As shown in FIGS. 9 and 12, each motor 154 is disposed on the surface of the main plate 221 of the holder 152 facing the side plate 399, behind the drive gear 155. Each motor 154 is disposed such that its drive shaft protrudes inward in the width direction of the printer 1. An input gear 196 configured to engage with the teeth of the corresponding drive gear 155 is fixed at the end of the drive shaft.

Each regulating member 156 is provided for each coupling male member 153, and is disposed so as to face the corresponding drive gear 155 from the inner side or right side with respect to the width direction of the printer 1. As shown in FIGS. 15A and 15B, each regulating member 156 integrally includes a main body 310, a pivot shaft 312, a cam surface contacting portion 313, and a pair of engaging portions 198. The main body 310 is shaped in a substantially parallelogram in front view. The pivot shaft 312 protrudes from a central portion of the front and rear surfaces of the main body 310 in the front-rear direction. The cam surface contacting portion 313 is formed at an upper end of the main body 310 to contact an inclined surface 305 and a flat surface 306 of a second linear cam 301. The engaging portion 198 extends from the lower end of the main body 310. A cutout portion 197 having a substantially semicircular shape is formed between the engaging portions 198, to allow the main body 172 of the coupling male member 153 to pass through the cutout portion 197, as shown in FIG. 9.

In association with the four regulating members 156, four support members 307 are provided in a row along the front-rear direction at some distance between the adjacent support members 307. The regulating members 156 are pivotally and individually supported by relevant support members 307. Each support member 307 is attached to the outer surface of the left side plate 399 facing the holder 152, using a plurality of screws 311. Each support member 307 includes a pair of side plates 317 opposing each other in the front-rear direction. The regulating member 156 is pivotally supported between the side plates 317 with the pivot shafts 312 rotatably received by the side plates 317.

Figure 10:
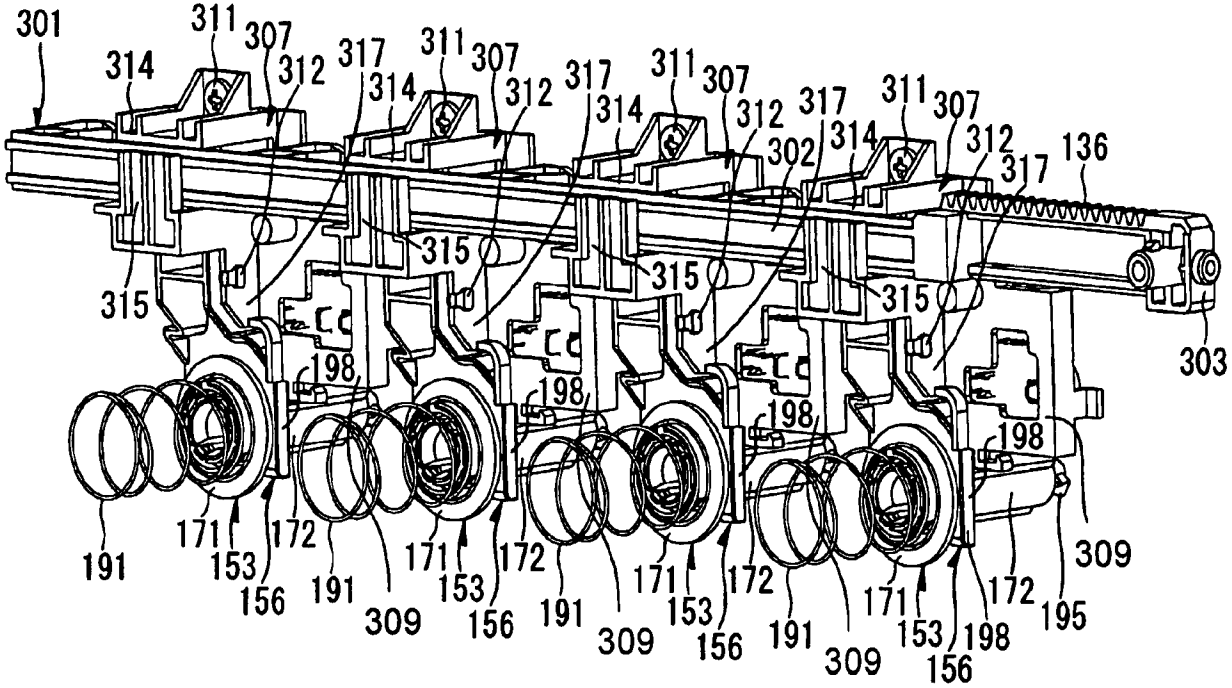
FIG. 10 is a perspective view of the drive force transmission unit shown in FIG. 9 viewed from a front left side, wherein a holder, motors, and developing drive gears are not illustrated in FIG. 10.

Each support member 307 includes an upper guide portion 314 and a side guide portion 315 as shown in, for example, FIG. 10. The upper guide portion 314 is configured to prevent the second linear cam 301 from moving upward and to move the second linear cam 301 in the front-rear direction. The side guide portion 315 is configured to prevent the second linear cam 301 from moving toward the holder 152 by reaction force of the spring 191 and to move the second linear cam 301 in the front-rear direction in cooperation with the upper guide portion 314.

Each support member 307 is integrally provided with a sensor mounting portion 309, as shown in FIG. 9, which extends forward from the front-side side plate 317. In the sensor mounting portion 309, the photoreceptor 308 of the optical sensor 173 is disposed for detecting the remaining amount of toner stored in a toner chamber 43.

Figure 11:
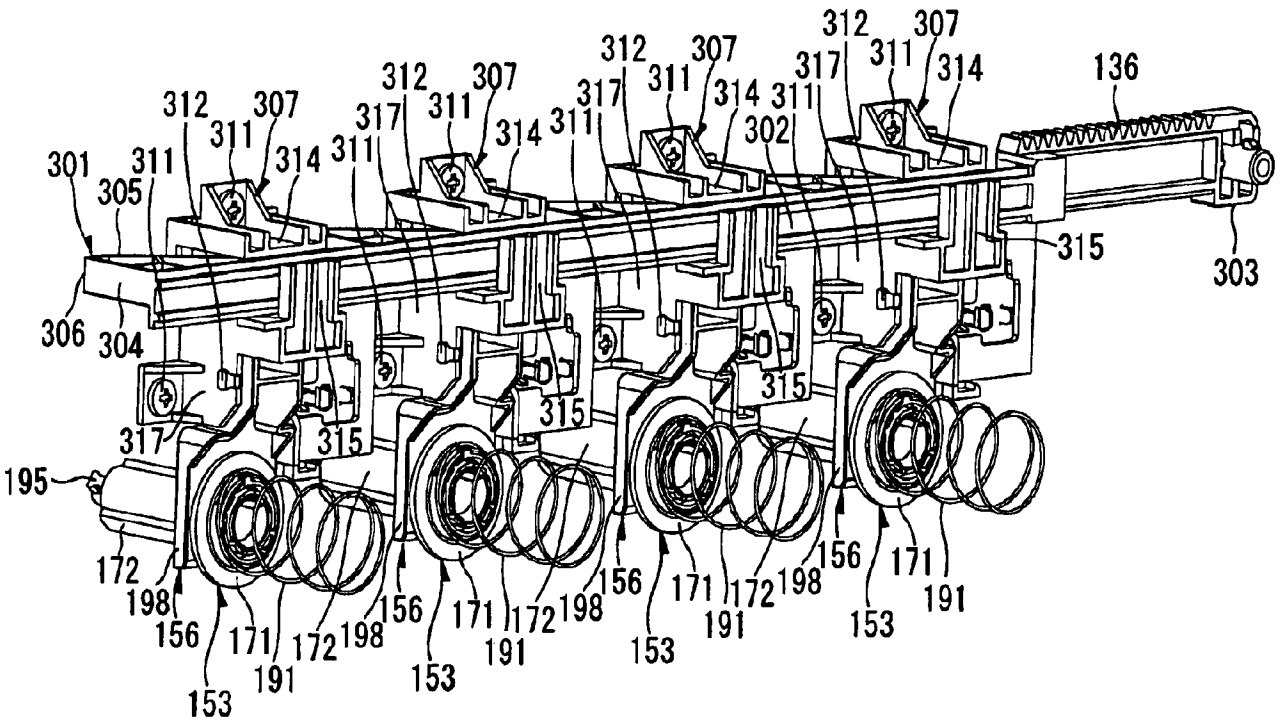
FIG. 11 is a perspective view of the drive force transmission unit shown in FIG. 9 viewed from a rear left side, wherein the holder, the motors, and the developing drive gears are not illustrated in FIG. 11.

The drive force transmission unit 151 is provided with the second linear cam 301 extending in the front-rear direction. The second linear cam 301 is supported by the support members 307 so as to move linearly in the front-rear direction, which is a direction substantially parallel with the pivot shafts 312 of the regulating members 156. As shown in FIG. 11, the second linear cam 301 integrally includes a lever body 302 formed in a rectangular shape elongated in the front-rear direction, a gear portion 303 connected to a front end of the lever body 302, and cam portions 304, each formed in a substantially triangular shape and protruding from an inner surface of the lever body 302.

A rack gear 136 is formed on an upper surface of the gear portion 303. The rack gear 136 is configured to engage with a joint movable gear 404, as will be described below with reference to FIGS. 16 and 17.

Four cam portions 304 are provided in association with the four regulating members 156, and arranged on a surface of the lever body 302 facing the side plate 399 at regular intervals in the front-rear direction. As shown in FIG. 9, each cam portion 304 includes an inclined surface 305 extending from the left front side to the right rear side, and a flat surface 306 extending from a rear end of the inclined surface 305 in parallel with the surface of the lever body 302.

When the second linear cam 301 is placed in the rearmost position, each regulating member 156 is disposed in the front of each cam portion 304 while facing the inner surface of the lever body 302, as shown in FIGS. 9 and 15A. Each regulating member 156 is in the coupling position where the pair of engaging portions 198 faces the flange 171 of the coupling male member 153 but does not contact the flange 171 due to the elastic force of the spring 191. In this state, each coupling male member 153 is in the coupling position where it is coupled with the relevant coupling female member 113 of the developing cartridge 27 if the drum unit 26 mounting therein the developing cartridges 27 is installed in the body casing 2.

When the second linear cam 301 is moved forward from the rearmost position, the cam contacting portion 313 relatively moves on the inclined surface 305 of the cam portion 304 toward the flat surface 306, as shown in FIG. 12. Consequently, each regulating member 156 pivots on the pivot shafts 312, and ends of the engaging portions 198 are brought into contact with the flange 171 of each coupling male member 153, as shown in FIG. 15B. The engaging portions 198 press the flange 171 toward the uncoupling position against the elastic force of the spring 191. Thus, the coupling male members 153 move from the coupling position to the uncoupling position where the ends of the engaging portions 198 are brought into contact with a central position of the flange 171 with respect to its vertical direction. In this state, connection between the coupling female members 113 of the developing cartridges 27 and the relevant coupling male members 153 is discontinued.

An interlocking mechanism 400 will be descried in detail below with reference to FIGS. 16 and 17.

Figure 17:
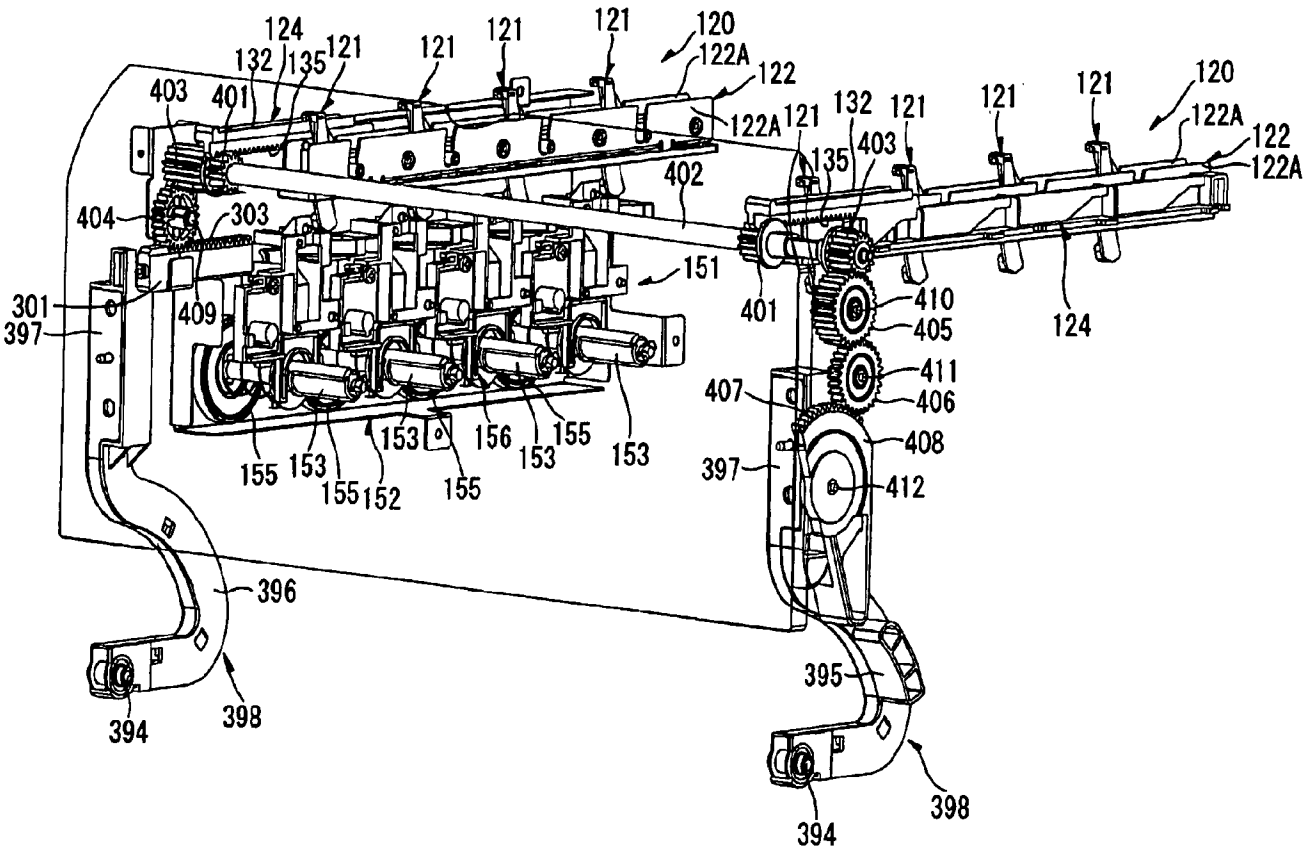
FIG. 17 is a perspective view of the pressing mechanisms, the drive force transmission unit, and the interlocking mechanism provided in the laser printer shown in FIG. 1, viewed from a front right side when the front cover is closed.

The color laser printer 1 includes the interlocking mechanism 400 for interlocking the first linear cams 124 and the second linear cam 301 so as to move the cams 124, 301 in association with the opening and closing operations of the front cover 9, as shown in FIGS. 16 and 17.

The front cover 9 is openably and closably supported by a pair of cover support members 398, so that it is movable between an open position, as shown in FIG. 16, where the front cover 9 is inclined frontward of the body casing 2 to uncover the opening 8, and a closed position, as shown in FIG. 17, where the front cover 9 is in an upright position along the front face of the body casing 2 to cover the opening 8.

Each cover support member 398 integrally includes a cover fixing portion 397 fixed at each end of the front cover 9 with respect to the width direction of the printer 1, and a bending portion 396 that is connected to the lower end of the cover fixing portion 397 when the front cover 9 is closed. The bending portion 396 extends rearward and bends so as to form a substantially "U" shape in side view when the front cover 9 is closed. The right-side cover support member 398 is integrally formed with an operation part 395 for operating an operation gear member 408 (described below) on an outer surface of the bending portion 396. The operation part 395 is formed to extend toward the front cover 9 from a portion near a curved or knee portion of the bending portion 396. A support shaft 394 extending in the width direction of the printer 1 from an end of the bending portion 396 is rotatably received in each side plate 399 of the body casing 2.

The interlocking mechanism 400 includes pressing member drive gears 401, a holding shaft 402, transmission gears 403, a joint movable gear 404, an intermediate gear 405, an input gear 406, and an operation gear member 408. The pressing member drive gears 401 engage with the rack gears 135 of the gear portions 132 of the first linear cams 124. The holding shaft 402 is rotatably supported by the side plates 399 within the body casing 2 and fits thereover the pressing member drive gears 401 so as not to rotate the gears 401 relative to the holding shaft 402. The transmission gears 403 are mounted to the ends of the holding shaft 402 so as not to rotate relative to the holding shaft 402. The joint movable gear 404 engages with the transmission gear 403 mounted on the left end of the holding shaft 402 and the rack gear 136 of the gear portion 303 of the second linear cam 301. The intermediate gear 405 engages with the transmission gear 403 mounted on the right end of the holding shaft 402. The input gear 406 engages with the intermediate gear 405. The operation gear member 408 is of a substantially sector shape in side view, and has a gear 407, which engages with the input gear 406, formed on a perimeter of the operation gear member 408.

The joint movable gear 404 is provided rotatably on a shaft 409 that extends in the width direction of the printer 1 and is received in the left side plate 399.

The intermediate gear 405 and the input gear 406 are provided rotatably on a shaft 410 and a shaft 411, respectively, which extend in the width direction of the printer 1 and are rotatably received in the right side plate 399.

The operation gear member 408 is provided rotatably on a shaft 412, which extends in the width direction of the printer 1 and is rotatably received in the right side plate 399. As shown in FIG. 16, with the front cover 9 open, an end of the operation gear member 408 opposite to the gear 407 contacts the operation part 395 of the cover support member 398 from above, and one end of the gear 407 engages with the input gear 406. As shown in FIG. 17, with the front cover 9 closed the end of the operation gear member 408 opposite to the gear 407 contacts the operation part 395 from the front, and the other end of the gear 407 engages with the input gear 406.

With this configuration, when the front cover 9 is opened, the operation part 395 forwardly presses the end of the operation gear member 408 opposite to the gear 407, so that the operation gear member 408 rotates about the shaft 412 (in the clockwise direction in FIGS. 16 and 17). With the rotation of the operation gear member 408, the input gear 406 is rotated (in the counterclockwise direction in FIGS. 16 and 17). The rotation of the input gear 406 is transmitted to the right-side transmission gear 403 via the intermediate gear 405. Accordingly, the right-side transmission gear 403, the holding shaft 402, the pressing member drive gears 401, and the left-side transmission gear 403 are rotated (in the counterclockwise direction in FIGS. 16 and 17). As a result, the first linear cams 124 are moved frontward, so that pressing of the developing cartridges 27 by the corresponding pressing members 121 is discontinued. With the rotation of the left-side transmission gear 403, the second linear cam 301 moves frontward, and the coupling male members 153 move from the coupling position to the uncoupling position. Thus, the connection between each coupling female member 113 of the developing cartridge 27 and the corresponding coupling male member 153 discontinues.

When the front cover 9 is closed, the operation part 395 of the cover support member 398 backwardly presses the end of the operation gear member 408 opposite to the gear 407, so that the operation gear member 408 is rotated on the shaft 412 (in the counterclockwise direction in FIGS. 16 and 17). With the rotation of the operation gear member 408, the input gear 406 is rotated (in the clockwise direction in FIGS. 16 and 17). The rotation is transmitted to the right-side transmission gear 403 via the intermediate gear 405. Accordingly, the right-side transmission gear 403, the holding shaft 402, the pressing member drive gears 401, and the left-side transmission gear 403 are rotated (in the counterclockwise direction in FIG. 16). As a result, the first linear cams 124 are moved rearward, the developing cartridges 27 are pressed by the corresponding pressing members 121. With the rotation of the left-side transmission gear 403, the second linear cam 301 moves rearward, and the coupling male members 153 move to the coupling position from the uncoupling position, and the coupling female member 113 of each developing cartridge 27 and the corresponding coupling male member 153 are coupled with each other.

A contact/separation mechanism 500 will be described in detail below.

Figure 18:
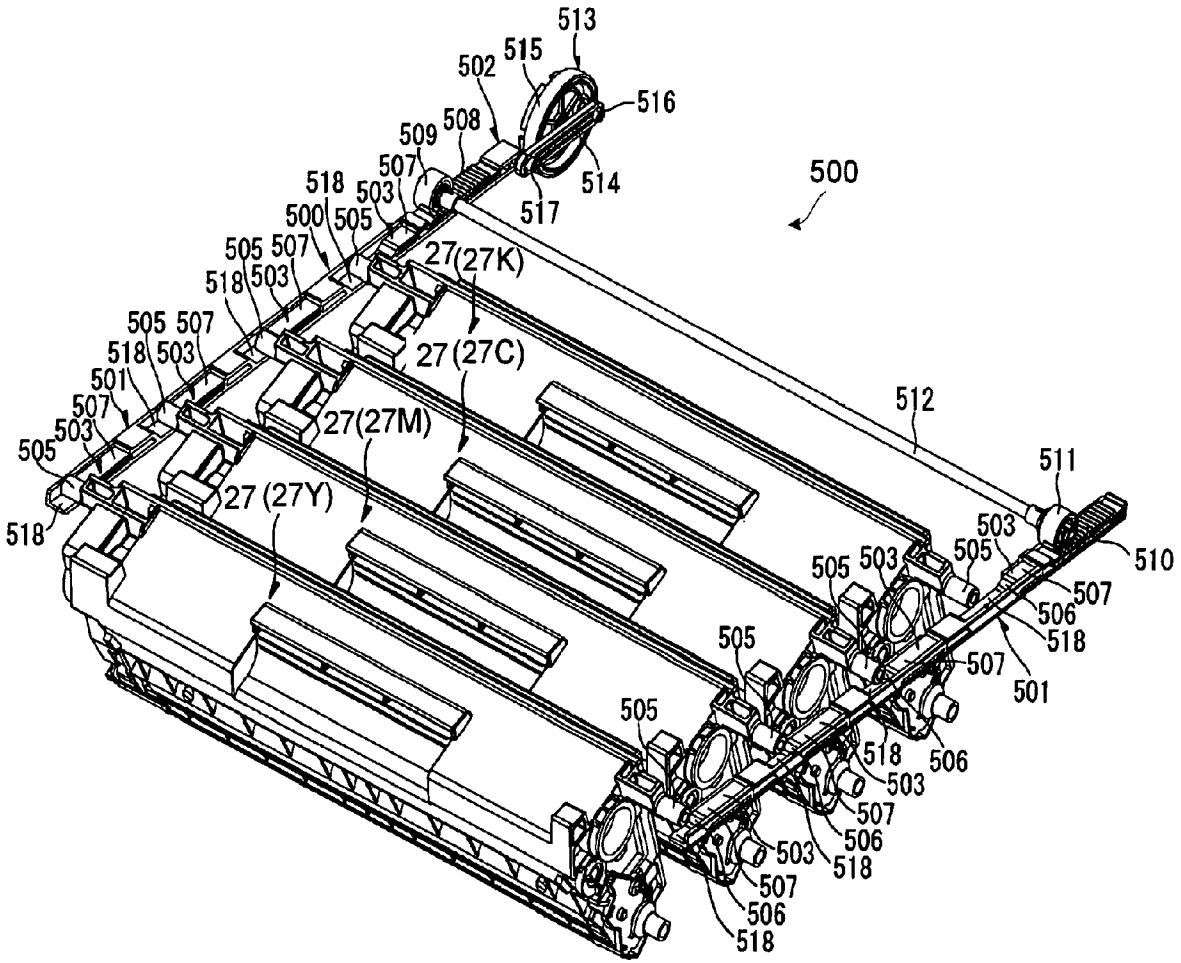
FIG. 18 is a perspective view of a contact-separation mechanism provided in the color laser printer shown in FIG. 1 viewed from an upper front right side.

As shown in FIG. 18, the color laser printer 1 includes a contact/separation mechanism 500 configured to linearly move the developing cartridges 27 between a contact position where the developing rollers 39 contact the corresponding photosensitive drums 29 and a separation position where the developing rollers 39 separate from the corresponding photosensitive drums 29.

As shown in FIG. 18, the contact/separation mechanism 500 includes a pair of contact/separation members 501 and a synchronous moving mechanism 502. The contact/separation members 501 are disposed so as to face each other across the four developing cartridges 27 with respect to the longitudinal direction of the developing cartridges 27. The contact/separation members 501 are configured to move straightly in the front-rear direction. The synchronous moving mechanism 502 is configured to linearly move the contact/separation members 501 in synchronization with each other.

Figure 19:
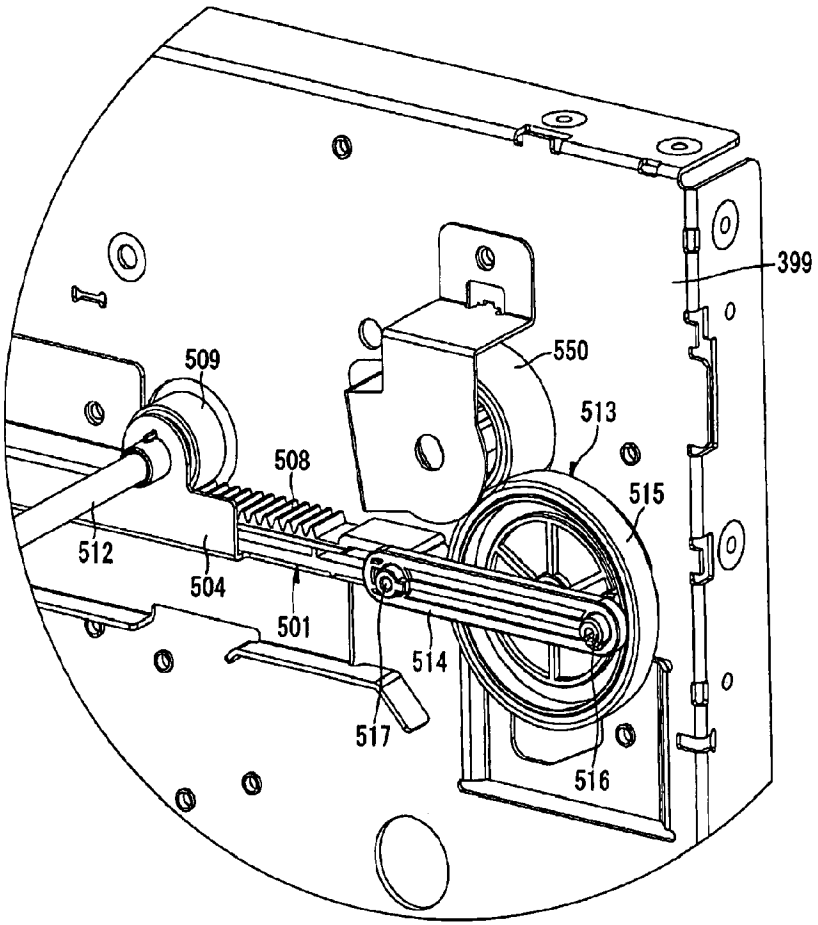
FIG. 19 is a perspective view of a rear end of a left contact-separation member shown in FIG. 18.

Each contact/separation member 501 is formed in a substantially plate shape elongated in the front-rear direction and includes cam portions 503 of a substantially trapezoidal shape in side view formed on an upper surface of the contact/separation member 501. Each contact/separation member 501 is provided on an inner surface of each side plate 399, which is disposed within the body casing 2, as shown in FIG. 19. Each contact/separation member 501 is slidably held by a substantially L-shaped contact/separation member holder 504 in cross section that extends in the front-rear direction. Each contact/separation member 501 contacts protrusions 505 of the developing cartridges 27 from underneath. The protrusion 505 extends outward along the longitudinal direction of the developing cartridge 27 from an upper end of each sidewall 107 of the developing frame 36 of the developing cartridge 27.

Four cam portions 503 are provided in each contact/separation member 501, in association with the protrusions 505. Each cam portion 503 includes a slide surface 506 provided at an angle from the lower front side to the upper rear side, and a flat separation surface 507 that extends from a rear end of the slide surface 506 in parallel with an upper surface of the contact/separation member 501.

Figure 20A:
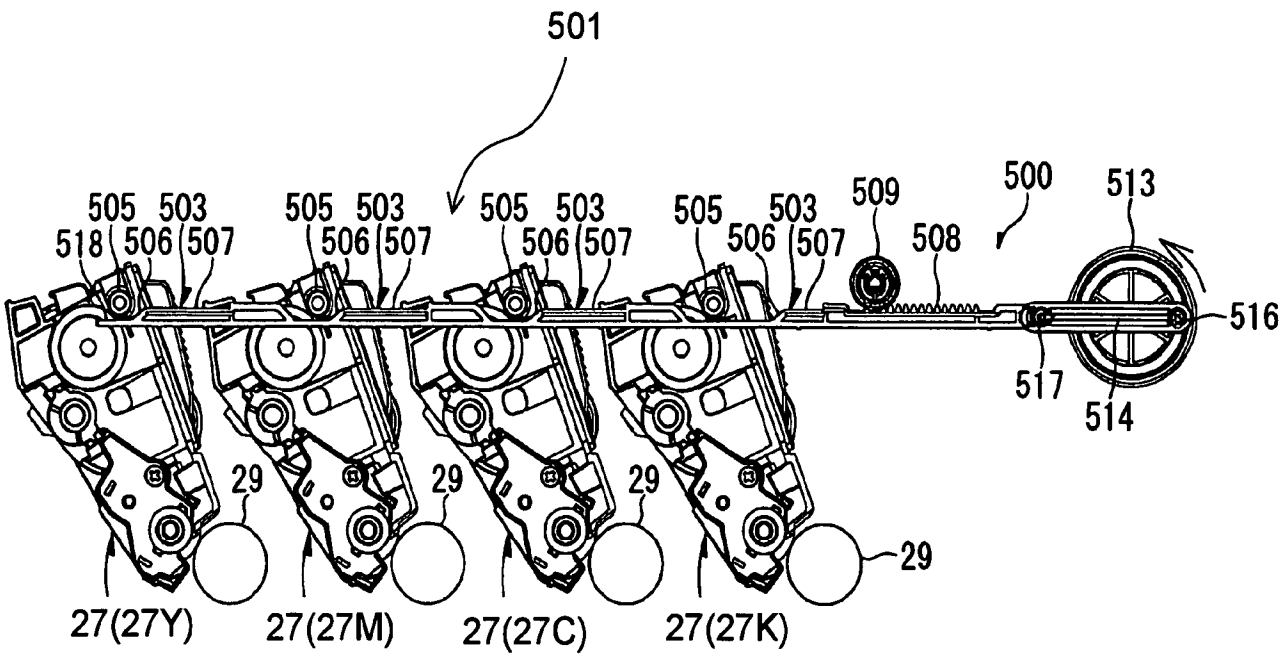
FIGS. 20A to 20C are right side views of the developing cartridges pressed against or separated from relevant photoconductive drums by the contact-separation members.
Figure 20B:
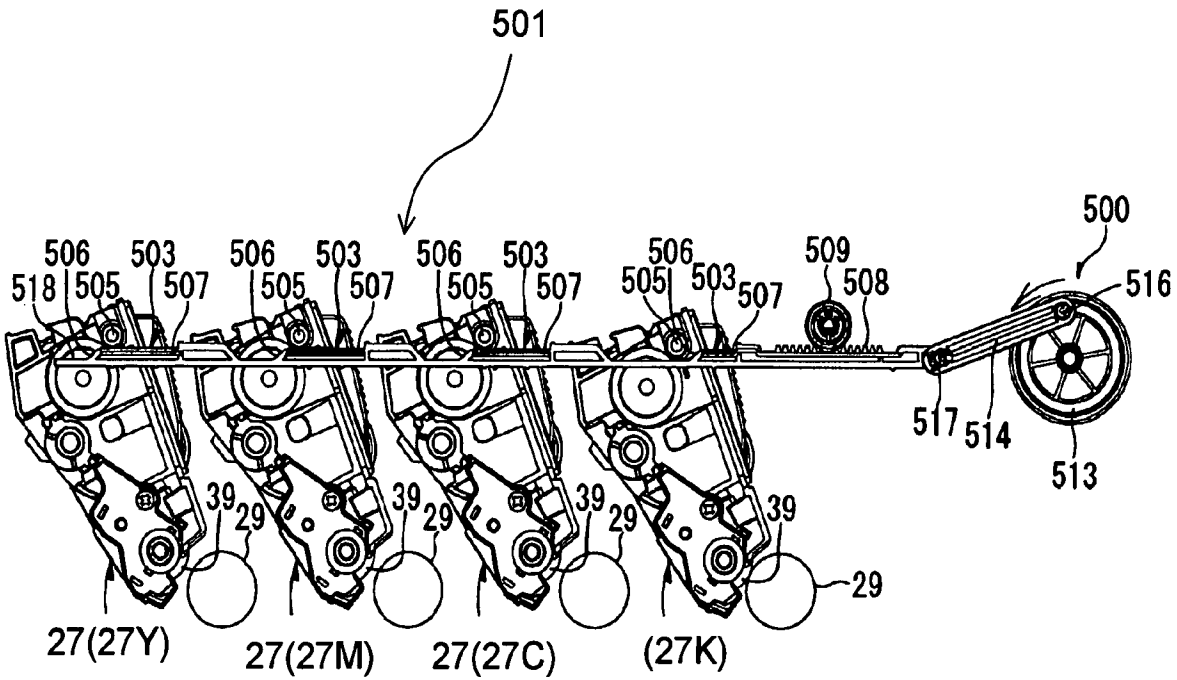
Figure 20C:
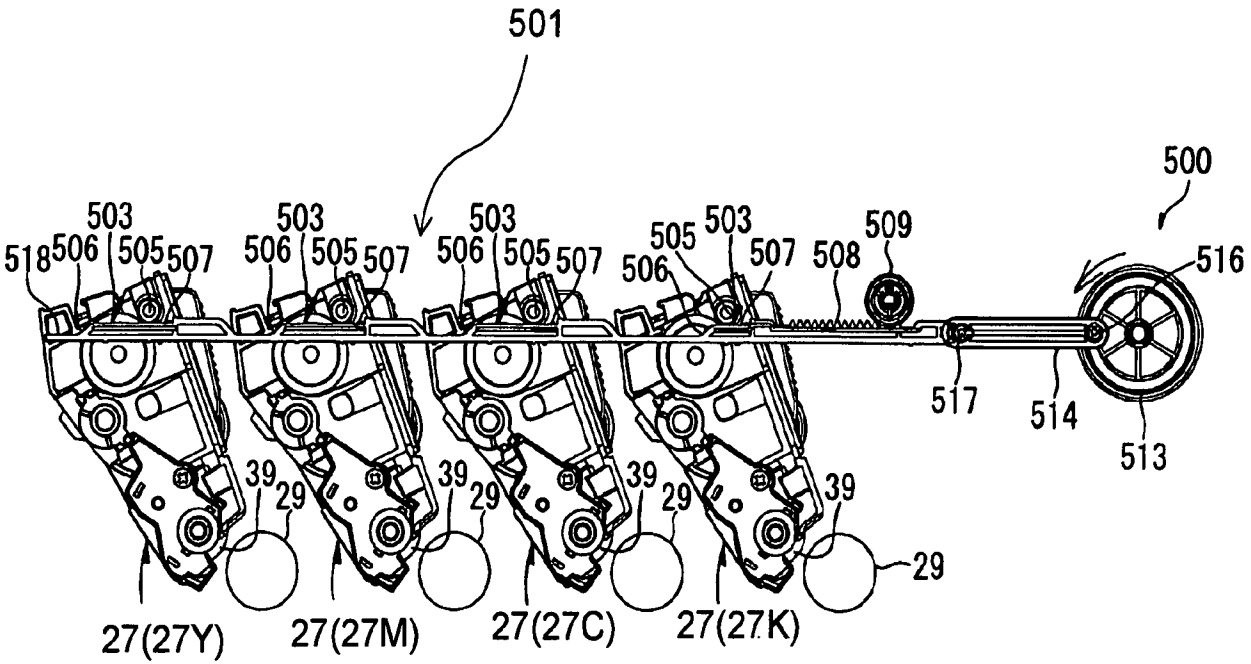

In association with the positions of the contact/separation members 501, the four cam portions 503 take states as shown in FIGS. 20A-20C, i.e., a state where all protrusions 505 are positioned in the front of the corresponding cam portions 503 as shown in FIG. 20A; a state where the protrusion 505 of the black developing cartridge 27K only is positioned in the front of the corresponding cam portion 503 and other protrusions 505 are disposed on the corresponding cam portions 503 as shown in FIG. 20B; and a state where all protrusions 505 are disposed on the corresponding cam portions 503 as shown in FIG. 20C.

More specifically, the first three cam portions 503 from the front side are formed into the substantially same shape and are disposed equi-distantly. The last (rearmost) cam portion 503 is disposed away from the third cam portion 503 with a greater distance than that between other three cam portions 503. The rearmost cam portion 503 has the separation surface 507 shorter than that of other three cam portions 503 with respect to the front-rear direction.

The synchronous moving mechanism 502 is configured to transmit drive force from the left contact/separation member 501 to the right contact/separation member 501, in association with the linear movement of the left separation member 501, to linearly move the right separation member 501.

More specifically, as shown in FIGS. 18 and 19, the synchronous moving mechanism 502 includes a left rack gear 508, a left pinion gear 509, a right rack gear 510, a right pinion gear 511, a connecting shaft 512, a transmission gear 550, a crank gear 513, and a conversion member 514. The left rack gear 508 is formed on an upper rear surface of the left contact/separation member 501. The left pinion gear 509 is configured to engage with the left rack gear 508. The right rack gear 510 is formed on an upper rear surface of the right contact/separation member 501. The right pinion gear 511 is configured to engage with the right rack gear 510. The connecting shaft 512 mounts the left pinion gear 509 and the right pinion gear 511 on each end thereof such that the left pinion gear 509 and the right pinion gear 511 do not rotate relative to the shaft 512. The transmission gear 550 is fixed on the left side plate 399 and is configured to transmit drive force from a motor (not shown). The crank gear 513 is rotated in one direction, (e.g., in the counterclockwise direction in FIG. 20), with the rotating force of the transmission gear 550. The conversion member 514 is configured to convert the rotation of the crank gear 513 to the linear movement for the left separation member 501.

The left pinion gear 509 and the right pinion gear 511 engage with the left rack gear 508 and the right rack gear 510, respectively, at their front ends when the contact/separation members 501 are moved to the rearmost positions, as shown in FIG. 20A. When the contact/separation members 501 are moved to the foremost positions as shown in FIG. 20C, the left pinion gear 509 and the right pinion gear 511 engage with the left rack gear 508 and the right rack gear 510, respectively, at their rear ends.

The connecting shaft 512 is disposed between the contact/separation member holders 504, and rotatably supported by the holders 504, as shown in FIG. 19.

The crank gear 513 is rotatably supported by a central shaft, which extends in the width direction of the printer 1 and is received in the side plate 399. A gear 515 that engages with the transmission gear 550 is formed on the perimeter of the crank gear 513. The crank gear 513 is formed with a rear-side protruding shaft 516 that protrudes inward in the width direction of the printer 1.

The rearmost end of the left contact/separation member 501 is formed with a front-side protruding shaft 517 that protrudes inward in the width direction of the printer 1. When the contact/separation member 501 is in the rearmost position or the foremost position, as shown in FIGS. 20A and 20C, the front-side protruding shaft 517 faces the rear-side protruding shaft 516 in the front-rear direction in parallel with each other.

The conversion member 514 is disposed between the rear-side protruding shaft 516 and the front-side protruding shaft 517, such that an end of the conversion member 514 moves along a movement path of the rear-side protruding shaft 516 when the crank gear 513 is rotated.

As shown in FIG. 20A, when the contact/separation members 501 are moved to the rearmost position, each protrusion 505 of the developing cartridges 27 is placed in front of the corresponding cam portion 503, and contacts a contact surface 518 which is an upper surface of the contact/separation members 501. Each developing cartridge 27 is placed in the contact position where the developing roller 39 of each developing cartridge 27 is pressed against the corresponding photosensitive drum 29.

As the transmission gear 550 is rotated by drive force from the motor (not shown) in the state as shown in FIG. 20A, the crank gear 513 is rotated counterclockwise in FIGS. 20A. Accordingly, the rear-side protruding shaft 516 moves frontward, and the left contact/separation member 501 moves frontward. With the movement of the left contact/separation member 501, the left pinion gear 509 rotates clockwise in FIG. 20B, and the rotation of the left pinion gear 509 is transmitted to the right pinion gear 511 via the connecting shaft 512. The right pinion gear 511 rotates in the same direction as the left pinion gear 509, and consequently, the right contact/separation member 501 moves frontward. As shown in FIG. 20B, when the crank gear 513 rotates approximately 90 degrees from the state shown in FIG. 20A, the protrusions 505 of the yellow, magenta and cyan developing cartridges 27Y, 27M, 27C slide on the sliding surfaces 506 of the corresponding cam portions 503 and are raised on the separation surfaces 507 of the corresponding cam portions 503. The protrusions 505 of the black developing cartridge 27K are positioned in the front of the corresponding cam portions 503. Thus, the yellow developing cartridge 27Y, the magenta developing cartridge 27M and the cyan developing cartridge 27C are moved upward to the separation position, and their developing rollers 39 separate from the corresponding photosensitive drums 39. Only the developing roller 39 of the black developing cartridge 27K is in contact with the corresponding photosensitive drum 29.

As shown in FIG. 20C, when the crank gear 513 is rotated counterclockwise approximately 180 degrees from the state shown in FIG. 20A, by driving the motor, the contact/separation members 501 are moved to the foremost position, the protrusions 505 of all developing cartridges 27 are raised on the separation surfaces 507 of the corresponding cam portions 503. Thus, all the developing cartridges 27 are moved up to the separation position where the developing rollers 39 of the developing cartridges 27 separate from the corresponding photosensitive drums 29.

When the motor is further driven to rotate the crank gear 513 counterclockwise in FIG. 20C, the rear-side protruding shaft 516 is moved rearward and accordingly the pair of contact/separation members 501 is moved rearward. When the crank gear 513 is rotated 180 degrees from the state shown in FIG. 20C, all the developing cartridges 27 are placed in the contact position as shown in FIG. 20A.

Figure 21:
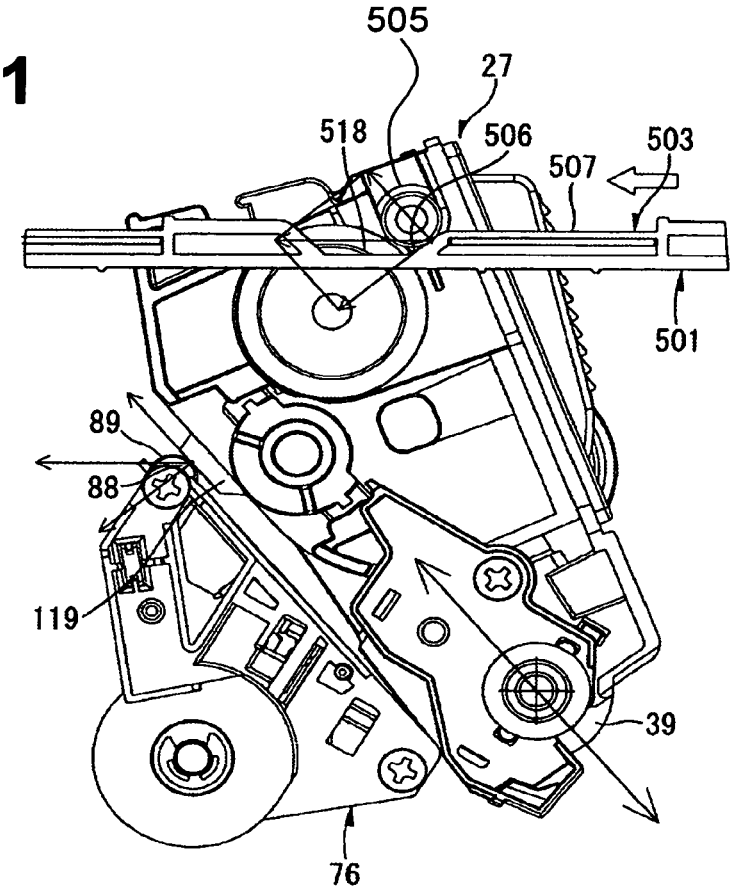
FIG. 21 is a right side view of one developing cartridge shown in FIG. 18 and its periphery.

When the developing cartridge 27 is raised by the cam portions 503, the protrusions 505 that slide on the sliding surfaces 506 of the cam portions 503 experience a force directing frontward from the sliding surface 506, as shown in FIG. 21. The force that the protrusion 505 experiences from the sliding surface 506 is resolved into a component acting in a direction parallel to the sliding surface 506 and a component acting in a direction perpendicular to the sliding surface 506. In this color laser printer 1, the slope of the sliding surface 506 of each cam portion 503 is parallel with a direction that the protrusion 119 of the developing cartridge 27 presses the support portion 88 (96). Thus, the component of force acting in the direction parallel to the sliding surface 506 acts as a force for pressing the protrusion 119 against the support portion 88 (96). As a result, the protrusion 119 can be firmly pressed against the support portion 88 (96), and the developing cartridges 27 can be stably moved from the contact position to the separation position.

According to the aspects, the developing cartridges 27 are pressed by the pair of pressing mechanisms 120, so that the developing rollers 39 can be pressed against the corresponding photosensitive drums 29. The pressing mechanisms 120 are disposed not in the drum unit 26 but on the support plate 24 of the scanner unit 20. This configuration reduces the cost of the drum unit 26, which has to be replaced with a new one when the photosensitive drum 29 deteriorates.

According to the aspects, the pair of pressing mechanisms 120 is disposed opposite to each other across the exposure unit 25 of the scanner unit 20 with respect to the width direction of the scanner unit 20. As the exposure unit 25 is disposed between the pressing mechanisms 120, space may be effectively utilized, so that the printer 1 may be downsized.

In addition, the pair of pressing mechanisms 120 is attached to the single support plate 24. Thus, as compared with a structure where the pressing mechanisms 120 are attached to separate members, pressing balance between the pressing mechanisms 120 can be ensured readily. Furthermore, the support plate 24 supports not only the pair of pressing mechanisms 120 but also the exposure unit 25. Thus, a component can be commonly used and thus the printer 1 may be further downsized.

The pair of pressing mechanisms 120 is configured to press the developing cartridges 27 with the relevant pair of pressing members 121. As the first linear cams 124 are moved linearly, the pressing members 121 can be moved accordingly. Thus, the operations of the printer 1 may be facilitated.

The second linear cam 301 linearly moves in association with the movement of the first linear cam 124, such that the coupling male members 153, which are configured to transmit the drive force individually to the corresponding developing cartridges 27, are placed in the coupling position or the uncoupling position. With the linear movement of the each first linear cam 124, the four pressing members 121 can be moved, and the four coupling male members 153 can be moved in association with the movement of the second linear cam 301. Thus, by linearly moving either first linear cams 124 or the second linear cam 301, the four sets of pressing members 121 and the four coupling male members 153 may be moved. Thus, operations of the printer 1 may further be facilitated.

In addition, the first linear cams 124 move linearly in conjunction with opening and closing movements of the front cover 9 that is opened or closed when the drum unit 26 is installed in or removed from the body casing 2. Thus, an operation only to linearly move the first linear cams 124 is not required separately from the opening/closing operation of the front cover 9. Further, an operation only to linearly move the second linear cam 301 is not required either, as the first linear cams 124 and the second linear cam 301 operate in association with each other. As a result, the operations of the printer 1 can be further facilitated.

Furthermore, the pair of contact/separation members 501 is provided in the printer 1. With the contact/separation members 501, the developing cartridges 27 can be moved to the contact position where the developing rollers 39 contact the corresponding photosensitive drums 29 and the separation position where the developing rollers 39 separate from the corresponding photosensitive drums 29. In each developing cartridge 27, the position where the pressing member 121 presses the developing cartridge 27 (that is, the top wall 108) and the position where the contact/separation member 501 contacts the developing cartridge 27 (that is, protrusion 505) are different, thus preventing local strain on the developing cartridge 27.

In addition, the positions of the developing cartridge 27 pressed by the pressing members 121 can be disposed near both sidewalls 107 of the developing cartridges 27, as the protrusions 505 are provided to protrude from both sidewalls 107. Thus, the pressing members 121 press the corresponding developing cartridges 27 at portions having relatively high rigidity, and a steady pressing of developing cartridges 27 by the pressing members 121 may be accomplished.

Using a component of force that the pressing members 121 press the developing cartridges 27, the protrusions 119 of the developing cartridges 27 are pressed against the support portions 88, 96. Thus, the developing cartridges 27 can be pressed firmly against the relevant drum sub units 28 and placed in position in the drum sub units 28.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples only are illustrative with the true scope of the invention being defined by the following claims.

What is claimed is:

1. An image forming apparatus comprising:

a main body;

a cover configured to pivot about a pivot axis between an open position and a closed position relative to the main body;

a plurality of cartridges, each of the plurality of cartridges being configured to contain a developer;

an endless belt extending in a direction where the plurality of cartridges are to be arranged in the main body;

a pressing mechanism configured to press each of the plurality of cartridges toward the endless belt such that the plurality of cartridges are positioned relative to the endless belt; and an interlocking mechanism configured to receive a drive force from the cover in response to pivoting of the cover from the open position to the closed position and transmit the drive force received from the cover to the pressing mechanism, such that the plurality of cartridges are positioned relative to the endless belt.

2. The image forming apparatus according to claim 1, wherein, when the plurality of cartridges are accommodated in the main body, the plurality of cartridges are disposed above the endless belt.

3. The image forming apparatus according to claim 1, wherein the pressing mechanism is configured to press each of the plurality of cartridges downward toward the endless belt.

4. The image forming apparatus according to claim 1, further comprising a holder configured to, when the cover is in the open position, move between an inside position where the holder is accommodated in the main body and an outside position where the holder is outside of the main body, the holder being configured to receive the plurality of cartridges arranged in the direction.

5. The image forming apparatus according to claim 1, further comprising a frame configured to, when the cover is in the open position, move between an inside position where the frame is accommodated in the main body and an outside position where the frame is outside of the main body, the frame being configured to receive the plurality of cartridges arranged in the direction.

6. The image forming apparatus according to claim 1, further comprising a plurality of image carriers arranged in the direction, each of the image carriers being configured to receive the developer from a corresponding one of the plurality of cartridges, wherein the endless belt is configured such that a recording medium passes between the image carriers and the endless belt.

7. The image forming apparatus according to claim 4, further comprising a plurality of image carriers arranged in the direction, each of the image carriers being configured to receive the developer from a corresponding one of the plurality of cartridges, wherein the endless belt is configured such that a recording medium passes between the image carriers and the endless belt.

8. The image forming apparatus according to claim 7, wherein the endless belt is configured to feed the recording medium on which the developer is transferred from each of the image carriers.

9. The image forming apparatus according to claim 7, wherein the holder holds the plurality of image carriers therein and each of the plurality of cartridges includes a developer carrier configured to supply the developer to a corresponding one of the plurality of image carriers.

10. The image forming apparatus according to claim 1, wherein the pressing mechanism includes a linear cam.

11. The image forming apparatus according to claim 1, wherein the interlocking mechanism includes a gear.

12. The image forming apparatus according to claim 1, wherein the cover is disposed on a front side of the main body.

* * * * *